US005233974A

United States Patent [19]

Senoue et al.

[11] Patent Number: 5,233,974

[45] Date of Patent: Aug. 10, 1993

[54] AIR MASSAGING APPARATUS WITH A SERIES OF SEQUENTIALLY INFLATING AIR BAGS

[75] Inventors: Masaharu Senoue, Yokkaichi; Haruhiko Naruse, Hikone, both of Japan

[73] Assignee: Matsushita Electric Works, Ltd., Osaka, Japan

[21] Appl. No.: 763,613

[22] Filed: Sep. 23, 1991

[30] Foreign Application Priority Data

Sep. 25, 1990 [JP] Japan ..... 2-255876

[51] Int. Cl.[5] ..... A61H 7/00; A47C 27/08; A47C 27/10

[52] U.S. Cl. ..... 128/64; 5/453; 5/455; 128/24 R

[58] Field of Search ..... 128/64, 33, 24 R, 38, 128/60; 5/933, 934, 914, 453, 455; 91/534

[56] References Cited

U.S. PATENT DOCUMENTS 3,411,496 11/1968 Strehler ..... 128/24
3,613,671 10/1971 Pool ..... 128/33 X
4,197,837 4/1980 Tringali et al. ..... 128/33
4,225,989 10/1980 Corbett et al. ..... 5/455 X
4,622,706 11/1986 Takeuchi ..... 128/33 X
4,825,486 5/1989 Kimua et al. ..... 5/453
4,953,247 9/1990 Hosty ..... 5/453
4,967,431 11/1990 Hargest et al. ..... 5/914 X
5,023,967 6/1991 Ferrand ..... 5/455 X
5,103,519 4/1992 Hasty ..... 5/914 X

*Primary Examiner*—Robert A. Hafer
*Assistant Examiner*—Brian E. Hanlon
*Attorney, Agent, or Firm*—Stevens, Davis, Miller & Mosher

[57] ABSTRACT

An air massaging apparatus utilizes a plurality of inflatable air bags of elongated configuration which are arranged in side-by-side relation along a line and supplied with compressed air from a pump to inflate. A distributor is provided to channel the compressed air from the pump selectively to the air bags for inflating the air bags one after another sequentially in a predetermined primary direction along the line of arrangement in such a manner as to inflate at least one air bag at a time while allowing the compressed air to escape from the remaining air bags. The distributor is controlled to inflate the air bags temporarily in a reverse order over a limited number of the air bags during an overall operation of sequentially inflating the air bags in the predetermined primary direction.

12 Claims, 27 Drawing Sheets

10
11
13
14
1A
2A
3A
4A
5A
6A
7A
1B
2B
3B
4B
5B
6B
7B
4
5

150B
142B
151B
155B
152B
160B
162B
141B
147
146B
148B
180
181
160A
166A
152A
141A
146A
148A
155A
143
142A
150A

AIR MASSAGING APPARATUS WITH A SERIES OF SEQUENTIALLY INFLATING AIR BAGS

BACKGROUND OF THE INVENTION

1. Field of the Invention

The present invention is directed to an air massaging apparatus having a plurality of air bags which are controlled to inflate one after another for applying corresponding raising and lowering massaging effects over an extend portion of a user's body.

2. Description of the Prior Art

As disclosed in U.S. Pat. No. 3,411,496, there has been proposed in the art an air massager utilizing a number of sequentially inflating air bags for applying a massage action over an extended portion of a user's body. The massager includes a distributor which selectively delivers compressed air from a pump to one or more of the air bags for sequentially inflating the air bags while evacuating the other air bags. The distributor is driven by an electric motor to cyclically channel the compressed air to the series of the air bags in such a manner as to inflate the air bags in a predetermined sequence. In other words, the distributor is configured to repeat the same cycle of inflating the air bags in the predetermined sequence for applying a monotonous massage action of pressing and relaxing the user's body progressively in the fixed direction along the portion of the user's body. However, such massaging action is found ineffective and unsatisfactory in that the pressing and releasing will always take place in the predetermined order along the portion of the body, as opposed to more professional massaging effect which is obtained when the pressing and releasing will takes place rather irregularly, i.e., temporarily in a reverse sequence during an overall operation of continuously applying the massage along the portion of the body in the predetermined direction. Therefore, it is mostly desired to incorporate such professional massage action in a massager.

SUMMARY OF THE INVENTION

In view of the above, the present invention is contemplated to provide an improved massaging apparatus capable of achieving the professional massage to the user's body. The massaging apparatus in accordance with the present invention comprises a plurality of inflatable air bags which are each of a generally elongated configuration and arranged in side-by-side relation along a line, and a pump supplying compressed air to inflate the air bags. A distributor is included to channel the compressed air from the pump selectively to the air bags for inflating the air bags one after another sequentially in a predetermined direction along the line of the arrangement in such a manner as to inflate at least one air bag at a time while evacuating the air from the remaining air bags. The distributor is controlled to inflate the air bags temporarily in a reverse order over a limited number of the air bags during an overall operation of sequentially inflating the air bags in the predetermined direction. With this result, the inflation of the air bags can shift back and forth, i.e., reciprocate partially over the limited number of the air bags, enabling the application of the pressing force repeatedly to a particular portion of the user's body before proceeding to apply the pressing force to another portion. Such massaging action is found to be comfortable and effective for promoting the blood circulation, as could be expected by a professional therapist.

Accordingly, it is a primary object of the present invention to provide an improved air massaging apparatus which is capable of achieving a comfortable and effective massage.

The distributor comprises a stepper motor rotating in a stepping motion and a channeling valve having an inlet port receiving the compressed air from the pump and a number of air ports connected in communication with respective ones of the air bags. The channeling valve is responsive to the stepping motion of the stepper motor for bringing at least one particular air port into communication with the inlet port for inflating the associated air bag or bags. With thus configured distributor, it is readily possible to shift the supply of the compressed air from one to another of the air bags immediately in response to the stepping motion of the stepper motor, thereby inflating the destined air bag or bags instantaneously to correspondingly give a strong pressing force. Likewise, by arranging the escape of the compressed air from the air bag in response to the stepping motion of the stepper motor, the compressed air can be promptly evacuated from the air bag such that the air bag can collapse instantaneously, thereby releasing the pressing force immediately. Consequently, the massage action with strong pressing force followed by immediate release thereof can be obtained for imparting an effective and comfortable massage to the user's body. Further, with the use of the stepper motor, it is also readily possible to change the sequence of inflating the air bags by controlling the stepping angle. Whereby an optimum sequence can be easily realized to perform a consistent and effective massage action.

It is therefore another object of the present invention to provide an air massaging apparatus which is capable of applying pressing rapidly and forcibly for improved massaging performance.

In a preferred embodiment, the channeling valve comprises a valve disk driven by the stepper motor to rotate about a rotation axis relative to a valve casing. The valve casing is formed with the inlet port at a portion concentric with the rotation axis and also with the air ports which are arranged circumferentially about the inlet port. The valve disk is formed with a radial channel which is in constant communication with the inlet port at its inner end and is in communication selectively with the air ports at its outer end. The outer end is elongated circumferentially about the rotation axis to extend over the adjacent plural ones of said air ports to define an extended passage. The extended passage is configured in relation to the air ports such that it can be selectively brought into communication with the plural adjacent ones of the air ports and into communication with only one of the air ports selectively at differing stepped angular displacements of the valve disk about the rotation axis. Therefore, by controlling to change the stepped angular displacement of the valve disk, it is readily possible to inflate the plural air bags simultaneously and inflate only one of the other air bags, thereby enabling the application of the pressing force in different fashions, depending upon different portion of the user's body.

It is therefore a further object of the present invention to provide an air massaging apparatus which is capable of realizing versatile and effective massaging action.

Preferably, the valve disk is also formed with a chamber extending about the rotation axis so as to be brought into communication with all of the air ports except for the air port or ports which are in current communication with the extended passage of the radial channel. The chamber is provided with an exhaust port which is in constant communication with the open air. Thus, the air bags which are not designated as being currently supplied with the compressed air from the pump can be brought into communication with the exhaust port so that the inside air of the non-designated air bags is allowed to escape through the chamber and the exhaust port into the open air to collapse those bags. Therefore, the feed-in and feed-out of the compressed air to and from the air bags can be made by a single valve disk to thereby reduce the number of components for the distributor, which is therefore a still further object of the present invention.

The valve disk is controlled in one operation mode to rotate in such a manner that the passage can be moved from particular one of the air ports to another across one or more intermediate air ports located therebetween. Thus, a unique massage action can be obtained in which the massaging force can be applied to particular spaced portions in succession, for example, from the shoulder to waist or the vice versa, which is therefore a further object of the present invention.

The massager includes a pressure controller for adjusting the pressure of the compressed air to be filled in the individual air bags and a speed controller for adjusting a cycle of sequentially inflating the air bags independently of the operation of the pressure controller. Consequently, delicate control can be made by selecting a suitable combination of the pressure and shifting the speed of inflating the air bags in sequence.

It is therefore a further object of the present invention to provide an air massaging apparatus which is capable of effecting delicate control for improved massaging performance.

Preferably, the air bags are disposed on an inflatable base mat dimensioned for use as a sleeping bed upon which the user may lie down and is supplied with the compressed air from the pump. The massaging apparatus is controlled to selectively provide a massaging mode of sequentially inflating the air bags to apply a massaging action portion by portion to a user's body and a rest mode of keeping the base mat inflated by the compressed air from the pump to support the user's body thereon. The base mat is collapsed into a flattened shape by evacuation of the compressed air therefrom when the massaging mode is selected and the air bags are collapsed into a flattened shape by evacuation of the compressed air therefrom when the rest mode is selected. Thus, the massage can be made without the interference with of the inflated base mat and the user can rest or sleep on the base mat without being annoyed by the inflated air bags. In the rest mode, a control is made to repeat raising and lowering of the air pressure within the base mat at a predetermined cycle so as to prevent local pressure concentration on the user's back, whereby assuring comfortable sleep and eliminating a bedsore or the like even when the base mat is utilized as the bed over a prolonged and continued duration, which is therefore a further object of the present invention.

The base mat comprises an inflatable balloon made of a stretchable material having elastic deformability into a generally rectangular planar configuration having top and bottom sheets. The balloon is formed internally with a plurality of suspension ribs connecting the top and bottom sheets at portions spaced along at least one dimension of said balloon. The suspension ribs are made of a non-stretchable material having no substantial elastic deformability but with enough flexibility in order to restrict undue swelling of the balloon. The balloon is surrounded together with the air bags by a covering which is also made of the like non-stretchable material so that the covering can restrict local swelling of the inflated balloon at portions between the suspension ribs when the down load is applied to the balloon as a consequence of supporting the user's body. With this result, the balloon can present a relative smooth supporting surface while it is compressed by the user's weight, whereby giving a correspondingly increased internal pressure or somewhat hard cushioning effect to support the user's body comfortably.

It is therefore a further object of the present invention to provide an air massaging apparatus which is capable of being alternately utilized as a bed with improved supporting characteristics.

In the preferred embodiment, one additional air bag is superimposed correspondingly on a particular one of the air bags and is cooperative therewith to define a waist massaging section with the two stacked air bags. The two stacked air bags are controlled to inflate simultaneously by the compressed air to provide a correspondingly strong massage action to the waist, which is therefore a further object of the present invention.

The base mat has a number of minute perforations through which the air inside is allowed to outflow. The base mat is controlled to be supplied with the compressed air through the distributor each time when particular one or ones of the air bags are evacuated such that the compressed air supplied to the base mat will outflow through the minute perforations to provide an air stream toward the user's body lying on the air bags. This is particularly advantageous when relatively strong massage is effected, for example to the waist by particular air bag or bags in that the air outflowing the base mat will cool the waist and therefore give additional comfort to the massage action.

The distributor may comprise a first distributor which channels the compressed air to said air bags for selective inflation thereof and a second distributor which channels the compressed air selectively from the air bags to the open air for selective evacuation thereof. With this provision of the first and second distributors, it is readily possible to control the feed-in and feed-out of the compressed air to and from the air bags independently in order to achieve more sophisticated control as to a timing relation between the inflation and collapse of the air bags for improved massaging performance.

These and still other objects and advantageous features of the present invention will become more apparent from the following description of the embodiments when taken in conjunction with the attached drawings.

DETAILED DESCRIPTION OF THE EMBODIMENTS

First Embodiment <FIGS. 1 to 27>

Figure 1:
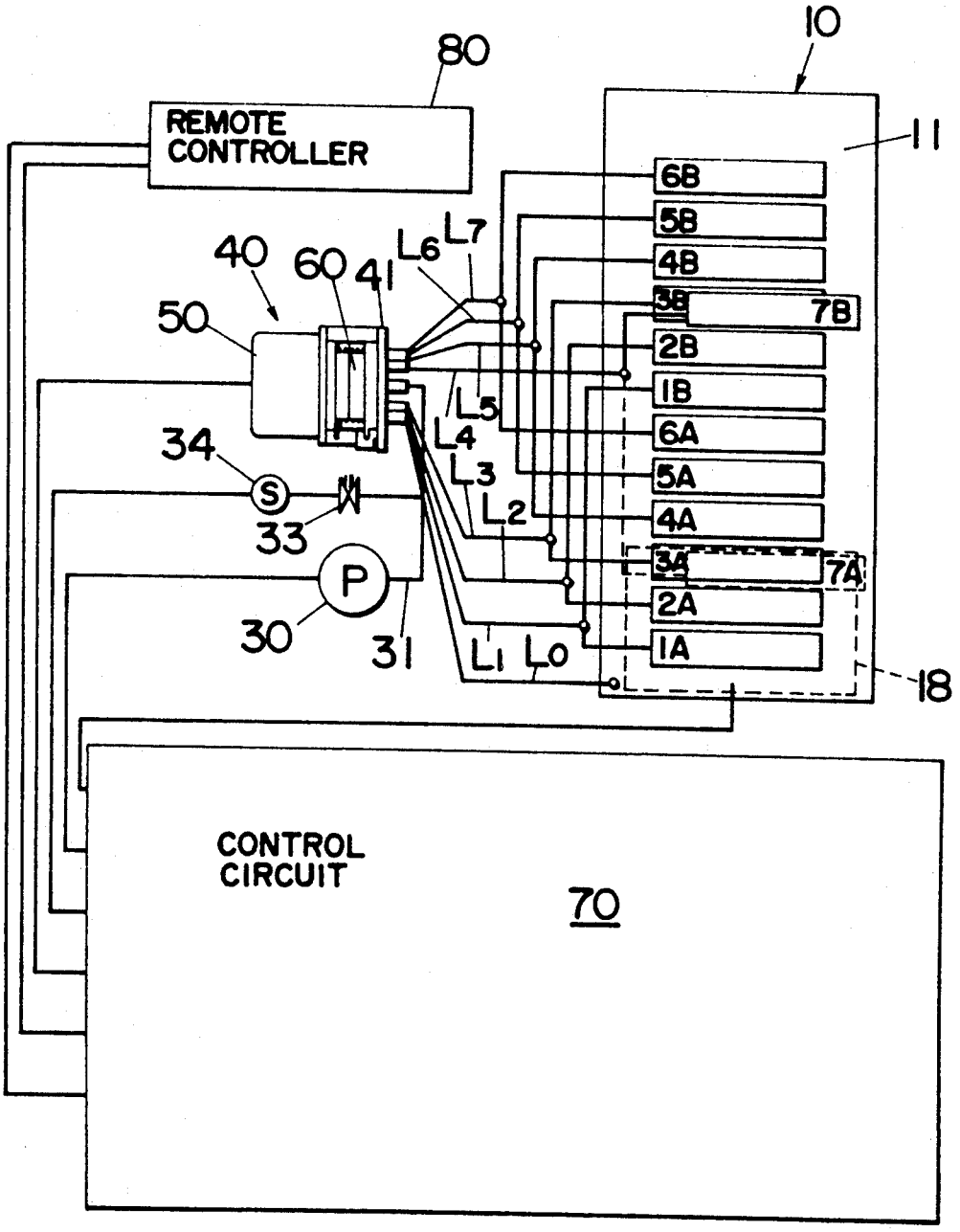
FIG. 1 is a schematic control diagram of an air massaging apparatus in accordance with a first embodiment of the present invention.

Referring now to FIG. 1, an air massaging apparatus in accordance with a first embodiment of the present invention is shown to comprise a mat assembly 10, an air pump 30, a distributor 40, a control circuit 70, and a remote controller 80. The mat assembly 10 includes an inflatable base mat 11 of a generally rectangular planar configuration and a plurality of inflatable air bags 1A to 7A and 1B to 7B. The base mat 11 and the air bags 1A to 7A and 1B to 7B are connected through the distributor 40 to the pump 30 such that they are selectively supplied with compressed air through respective feed lines $L_0$ to $L_7$ to be inflated thereby under the operation of the control circuit 70 in accordance with a particular mode selected by an user at the remote controller 80, as will be discussed later.

Figures 2, 3, 4, 5:
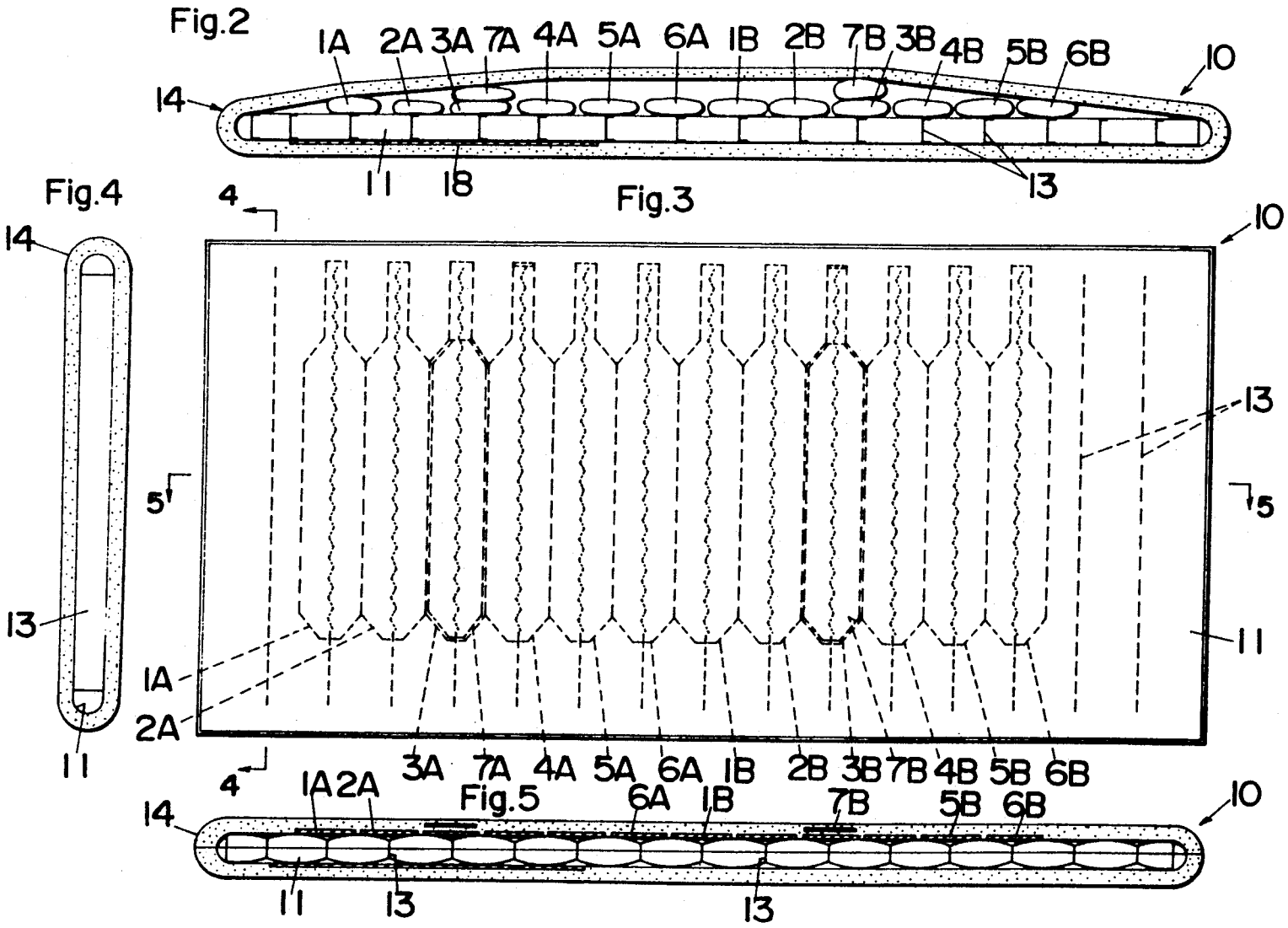
FIG. 2 is a sectional view in a greatly schematic representation of a mat assembly including a base mat and a plurality of air bags disposed thereon employed in the massaging apparatus.
FIG. 3 is a top view of the mat assembly.
FIG. 4 is a cross section taken along line 4—4 of FIG. 3.
FIG. 5 is a cross section taken along line 5—5 of FIG. 3 with the base mat inflated and with the air bags collapsed.
Figure 6:
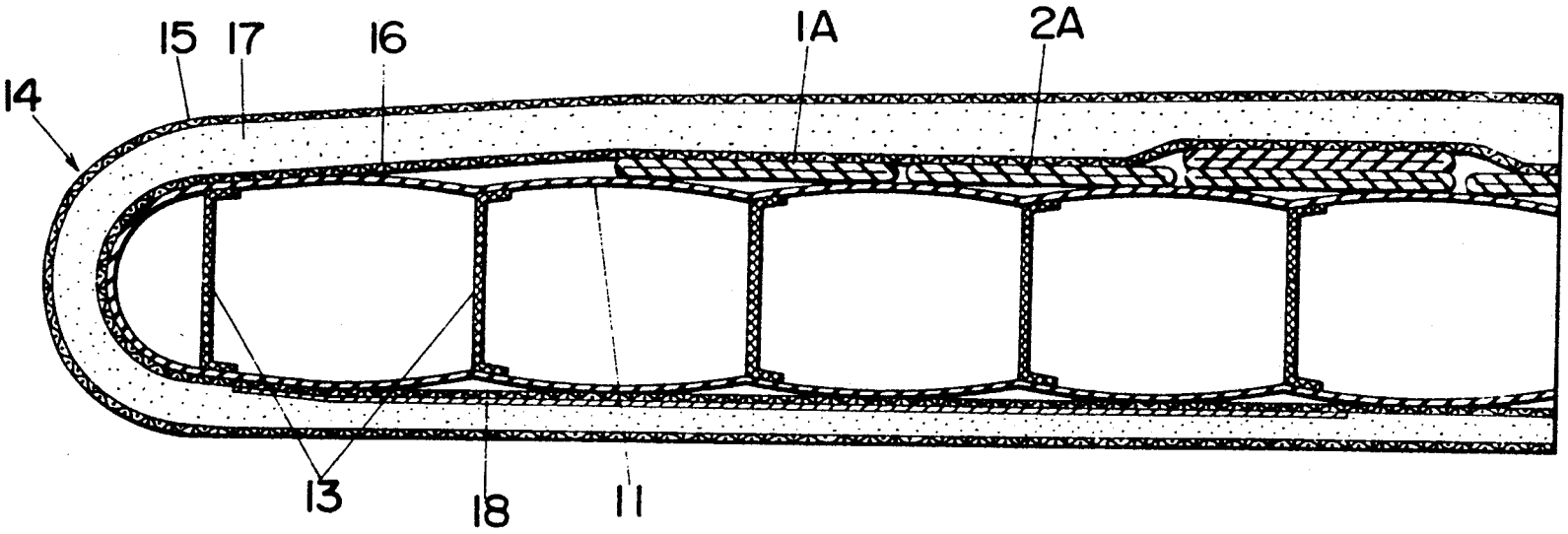
FIG. 6 is an enlarged section of a portion of FIG. 5.
Figure 7:
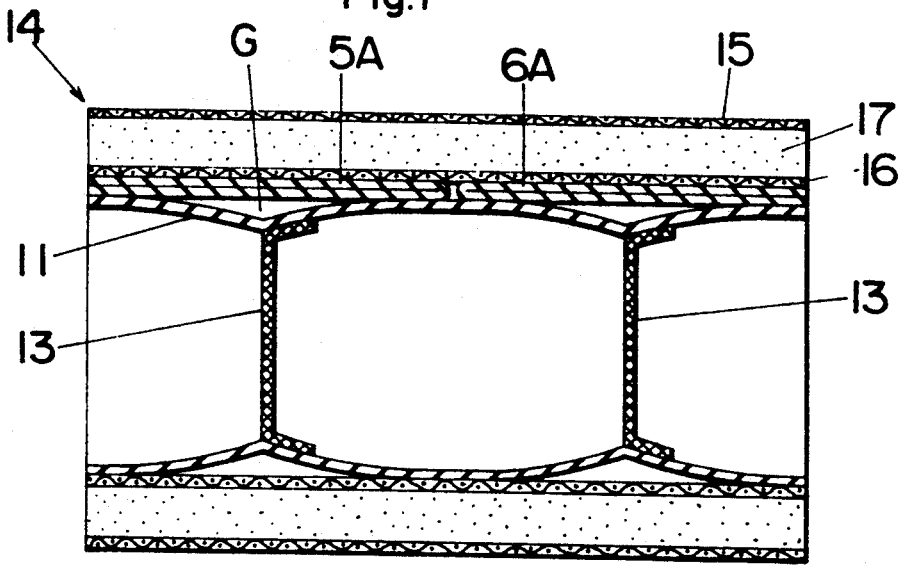
FIG. 7 is a further enlarged section of a portion of FIG. 6 at a condition where the base mat is inflated with no external down load being applied thereto as indicative of the absence of a user's body.
Figure 8:
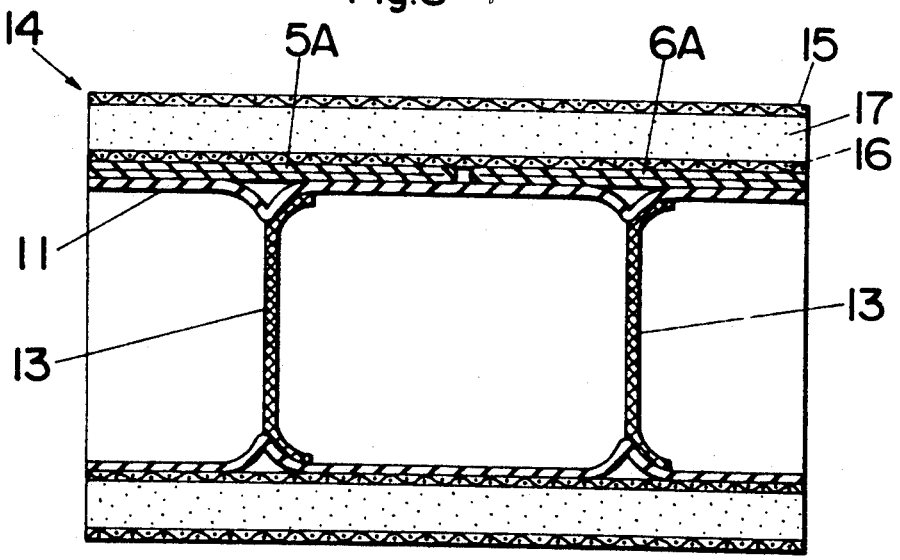
FIG. 8 is an enlarged section similar to FIG. 7 but shown at a condition where the base mat is inflated at another condition where the base mat is inflated while supporting thereon the user's body.

The air bags 1A to 7A and 1B to 7B are disposed on the base mat 11 in side-by-side relation along the length of the base mat 11, as also shown in FIGS. 2 and 3. It is noted here that FIG. 2 is a schematic representation in Which the base mat 10 and the air bags are all shown to be rather inflated only for an easy reference purpose, although such simultaneous inflation will not occur in the operations of the present invention. The base mat 11 is configured to have general length and width dimensions so as to be adapted for use as a sleeping bed on which the user lies down. As shown in FIGS. 4 to 8, the base mat 11 is in the form of a balloon made of stretchable urethan resin with elastic deformability into a generally rectangular planar configuration having top and low sheets. The base mat or balloon 11 includes a number of longitudinally spaced and laterally extending suspension ribs 13 Which connect the top and low sheets of the base mat 11 in order to prevent undue swelling of the base mat 11. For this purpose, the suspension ribs 13 are made of non-stretchable material, for example, a fabric-plastic composite sheet having no substantial elasticity but enough flexibility to allow the base mat 11 to collapsed into a flat configuration when evacuated. As shown in FIG. 4, the suspension ribs 13 terminate before the lateral ends of the base mat 11 so as to allow the circulation of the air throughout the entire base mat 11. The base mat 11 is surrounded together with the air bags by a covering 14 composed of an exterior fabric 15, a backing fabric 16, and a cushioning layer 17 sandwiched therebetween. The backing fabric 16 is made of like non-stretchable material such as unwoven fabric in order to restrict a local swelling of the base mat 11 for providing a substantially flat supporting surface with a suitable spring or cushioning performance. That is, when the base mat 11 is inflated in the absence of substantial down load acting on the base mat 11, the internal pressure acts to elongate the upper and lower sheets of the base mat 11 at portions between the suspension ribs 13, thereby leaving localized bulge thereat with attendant gaps G between the base mat 11 and the backing fabric 16 of the covering 14. However, when the user lies down on the base mat 11 or turns over to apply the down load to the bulged portions, the resulting increased internal pressure Will act to elongate the budged portions of the base mat 11 to an extent of minimizing the gaps G, as shown in FIG. 7. At this time, the non-stretchable backing fabric 16 acts to restrict further elongation or elastic deformation of the base mat 11 so as to keep it flattened while permitting the base mat 11 to be further compressed by the load acting on the base mat 11, thereby presenting the generally flat supporting surface with increased compression or hardened cushioning effect. In other words, the base mat 11 can assume the condition of FIG. 8 rapidly in response to the load applied thereto. It should be noted here that the air escaping from the gaps G will spread over the base mat 11 to stretch the other portions of the base mat 11 suffering no substantial load. With the combination effect of the suspension ribs 13 and the backing fabric 16 both made of non-stretchable material, it is possible to promptly dampen vibrations of the base mat 11 subjecting to the load variations in use and therefore assure comfortable bed characteristics.

A plate heater 18 is disposed partially on the outer bottom of the base mat 11 to Warm the base mat 11, particularly the portion supporting the legs of the user's body. As shown in FIGS. 1 and 3, the air bags 20 are arranged to include two additional air bags 7A and 7B superimposed on the corresponding air bags 3A and 3B so as to define a leg massage section with the stacked pair of the air bags 3A and 7A which are controlled to inflate simultaneously and as well to define a waist massage section with the like stacked pair of the air bags 3B and 7B to be inflated simultaneously.

As shown in FIGS. 11 to 14, the distributor 40 comprises a valve casing with a spaced pair of a valve plate 41 and a mount plate 42 on which an electric stepper motor 50 is mounted with its output rotor shaft 51 extending through the mount plate 42 toward the valve plate 41. The valve plate 41 and the mount plate 42 are assembled together by means of posts 43 so as to receive therebetween a valve disk 60 and a sleeve 55. The posts 43 are circumferentially spaced about a rotation axis of the rotor shaft 51 and are secured respectively to the valve plate 41 and the mount plate 42 by means of screws 44. The valve plate 41 is formed at its center with an intake port 46 which is in concentric relation to the rotation axis of the rotor shaft 51 and is connected through a pump line 31 to the pump 30 to receive compressed air therefrom. The valve plate 41 is also formed with eight air ports 47-0 to 47-7 circumferentially spaced at regular intervals, i.e., by an angle of 22 5° about the intake port 46 for coupling to the associated air bags 1A to 7A and 1B to 7B through the feed lines $L_0$ to $L_7$. The valve disk 60 is connected by means of a vane joint 52 to the rotor shaft 51 of the stepper motor 50 to be driven to rotate in a stepwise manner at suitable angular displacements about the rotation axis with its front face in an intimate sliding contact with the valve plate 41. The vane joint 52 is secured at its rear end to the rotor shaft 51 and extends through a correspondingly shaped hole 56 of the sleeve 55 to fit into a correspondingly shaped bore 61 in the rear of the valve disk 60 so that the sleeve 55 rotates together with the valve disk 60. A coil spring 57 is interposed between the sleeve 55 and the valve disk 60 to urge the valve disk 60 against the valve plate 41 for assuring intimate sealing contact therebetween while rotating the valve disk 60 relative to the valve plate 41. The valve disk 60, the sleeve 55, valve plate 41 and the mount plate 42 are made of plastic material with a low friction factor to permit the valve disk 60 and sleeve 55 to rotate smoothly relative to the valve plate 41 and the mount plate 42, respectively. The vane joint 52 is embedded with damper fittings 53 which cushion possible inclination of the sleeve 55 and the valve disk 60 so as to maintain an exact alignment thereof with the rotation axis.

Figure 13:
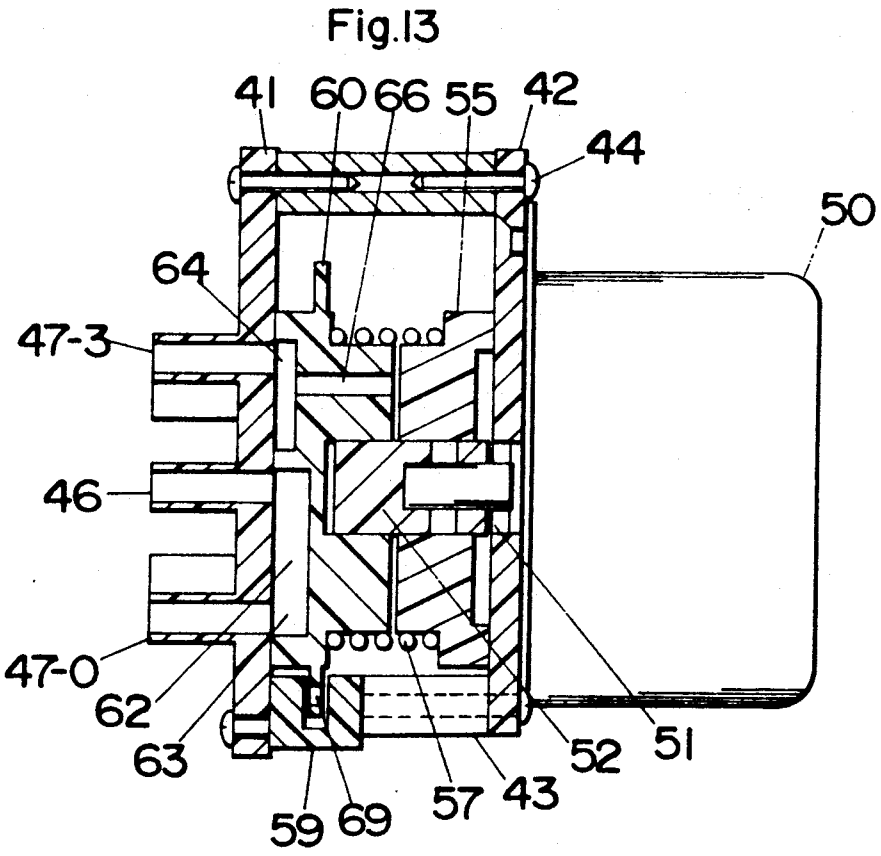
FIG. 13 is a cross section taken along 13—13 of FIG. 12.
Figure 12:
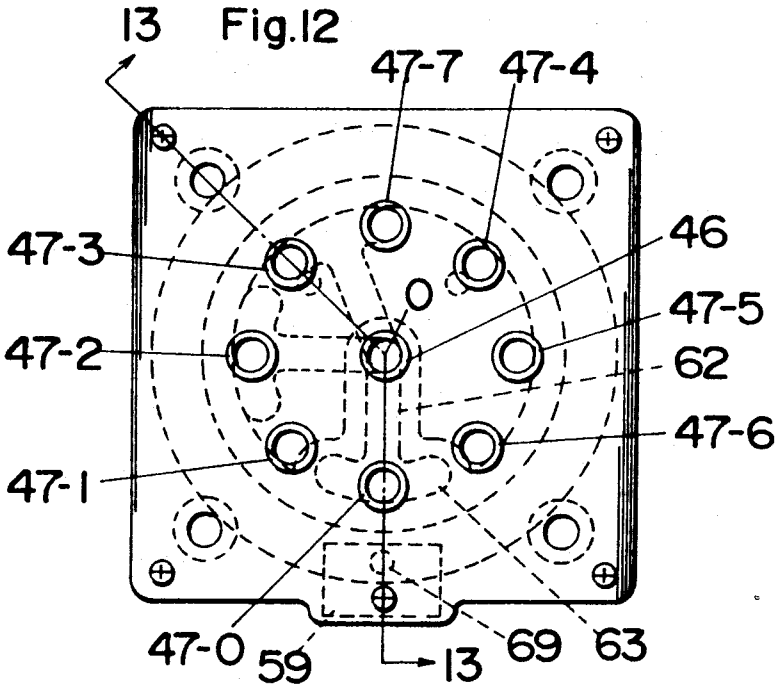
FIG. 12 is a front view of the distributor showing a number of air ports adapted to be coupled to the air bags.
Figure 14:
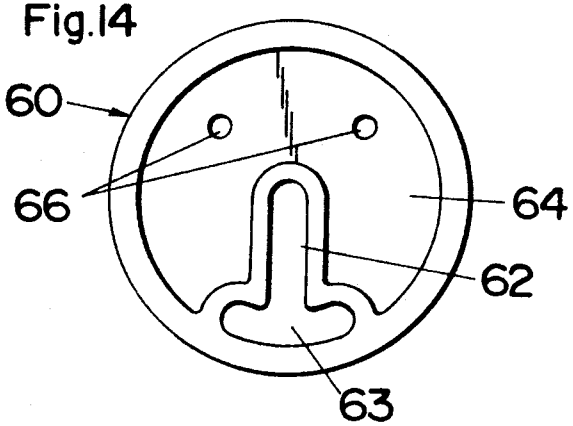
FIG. 14 is a front view of a valve disk of the distributor.
Figure 15:
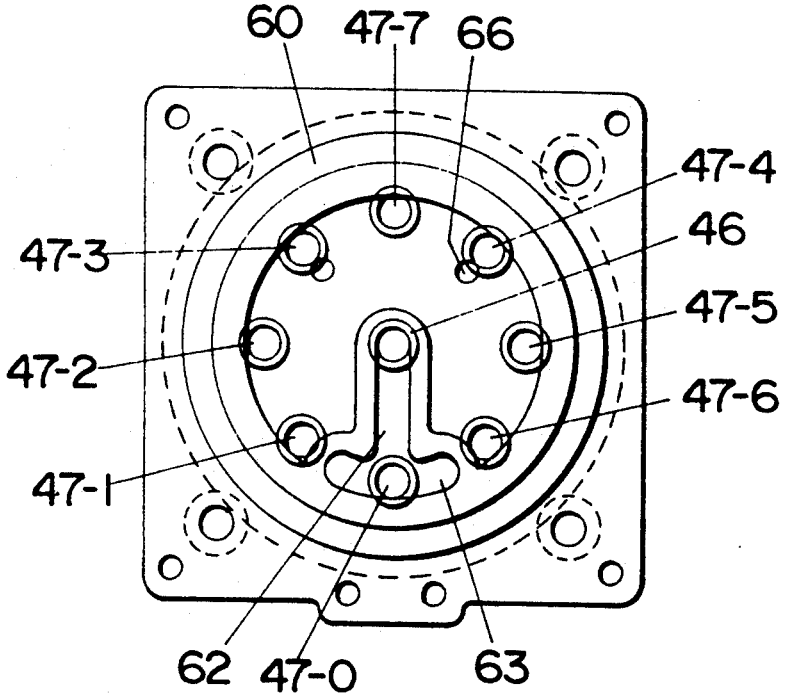
FIG. 15 is an explanatory view illustrating the operation of the distributor for inflating the base mat.

The valve disk 60 is formed in its front surface with a radial channel 62 extending from its center and terminating in a circumferentially extended passage 63, as best shown in FIG. 14. The radially inner end of the channel 62 is kept in constant communication with the intake port 46 while the passage 63 is brought selectively into one or two of the air ports 47 depending upon the angular displacement of the valve disk 60. That is, the passage 63 is dimensioned to cover the two adjacent air ports 47 at a time so that it can come into communication simultaneously with the two adjacent air ports 47 at a certain angular disposition of the valve disk 60 and into communication with only one air port 47 at another angular disposition of the valve disk 60. Also the valve disk 60 is recessed to form a chamber 64 which extends substantially over the major portion of the front surface as being separated from the radial channel 62 by a partition 65 and which is communicated into the open air through axially extending exhaust ports 66 and a clearance between the valve disk 60 and the sleeve 55. The chamber 64 is configured to cover all the air ports 47 expect for the one or two air ports which comes into communication with the passage 63, whereby allowing to evacuate the compressed air from the air bags or base mat 11 which are not currently supplied with the compressed air. For example, when the valve disk 60 comes into a position, as indicated in FIGS. 12 and 13, to communicate the passage 63 with the air port 47-0, the compressed air entering the intake port 46 from the pump 30 is guided to flow radially outwardly through the channel 62 and is directed through the passage 63, the air port 47-0 and corresponding feed line $L_O$ for inflating the base mat 11. At this occurrence, the remaining air ports 47-1 to 47-7 comes into communication with the chamber 64 to thereby allow the compressed air from the associated air bags 1A to 7A and 1B to 7B to escape through a route of the chamber 64 and the exhaust ports 66 into the open air, thereby collapsing the air bags. When the valve disk 60 is rotated clockwise in FIG. 12 by an angle of 90° from the above position to communicate the passage 63 with the air port 47-2, the compressed air is channeled through feed line L2 to inflate the associated air bags 2A and 2B while the remaining air bags and the base mat 11 are evacuated of the compressed air through the chamber 64 and the exhaust ports 66 to be thereby collapsed. When the valve disk 60 comes into such a position as to communicate the passage 63 with the two adjacent air ports 47-3 and 47-7, as shown in FIG. 12, the compressed air is supplied through these air ports to inflate the associated air bags 3A, 3B, 7A, and 7B forming the leg and waist massage sections, while evacuating the remaining air bags. In this manner, as the valve disk 60 rotates in a stepwise manner, the distributor 40 acts to selectively inflate the associated the air bags or the base mat 11 while collapsing the remaining air bags or base mat 11. The distributor 40 also includes a position sensor 59, for example, a photoelectric sensor detecting the angular disposition of the valve disk 60 in cooperation with an aperture 69 in the periphery of the valve disk 60 at a position corresponding to the center of the passage 63. The position sensor 59 generates a light beam toward the periphery of the valve disk 60 and issues a signal when the light beam passes through the aperture 69 indicating that the valve disk 60 is at a reference position where the passage 63 comes into communication with the air port 47-0 leading to the base mat 11.

Turning back to FIG. 1, the air bags are divided into two groups each including six side-by-side arranged air bags 1A to 6A (1B to 6B) plus one air bag 7A (7B) superimposed on the air bag 3A (3B). The two groups are arranged in series along the length of the base mat 11 to cover the upper and lower halves of the user's body, respectively. Each of the six side-by-side arranged air bags in one group is paired with each one of the air bags located in the same position in the other group to provide six pairs of air bags 1A and 1B, 2A and 2B, . . . 6A and 6B which are collectively coupled respectively to the air ports 47-1 to 47-6 through the feed lines $L_1$ to $L_6$. Likewise, the superimposed air bags 7A and 7B are paired and collectively coupled to the air port 47-7 through the feed line $L_7$. The base mat 11 is coupled to the air port 47-0 through the feed line $L_0$. Connected to the pump line 31 is a sensor line 32 carrying a check valve 33 and a pressure sensor 34 for sensing the pressure level of the compressed air being supplied from the pump 30 and providing to the control circuit 70 a pressure signal indicative of the pressure level.

The control circuit 70 provides two basic operation modes, i.e., a rest mode of inflating the base mat 11 for use as the bed and a massage mode of sequentially inflating the air bags for applying the massage action to the back of the user's body lying over the series of the air bags 1A to 7A and 1B to 7B. Further, the rest mode includes an inactive mode and an active mode, while the massage mode includes a straight massage mode and several other advanced massage modes. These modes are selected by the user at the remote controller 80.

Operation of these rest and massage modes will be discussed with reference to the flow charts of FIGS. 20 to 27 and also to FIGS. 15 to 19 illustrating several angular positions that the valve disk 60 assumes relative to the valve plate 41. It is noted that the rest mode and the massage mode are exclusive to each other and are therefore not available concurrently. Upon the apparatus being powered on, the control circuit 70 resets the distributor 40 to move the valve disk 60 into the reference position where the passage 63 is in communication with the air port 47-0 and proceeds to the selected operation mode.

1-1 Inactive Rest Mode

Figure 20:
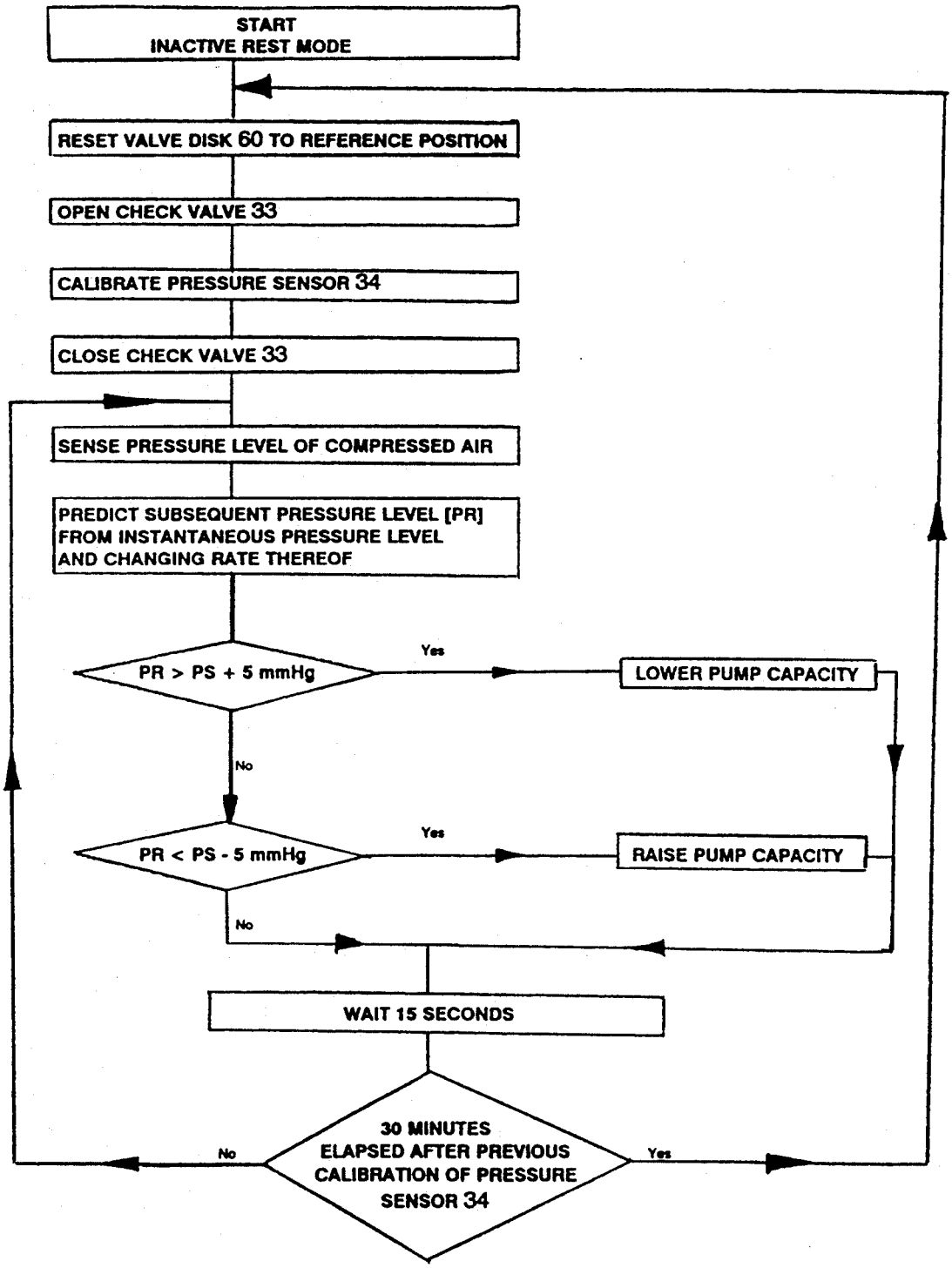
FIGS. 20 and 21 are flow charts respectively for illustrating inactive and active rest modes of inflating the base mat.

As shown in FIG. 20, after resetting the distributor 40 to assume the reference position, the check valve 33 is firstly opened to calibrate the pressure sensor 34 by exposure to the atmospheric pressure and is then closed to be ready for sensing the pressure of the compressed air supplied from the pump 30 to the distributor 40. Thereafter, the control circuit 70 actuates the pump 30 to generate the compressed air for inflating the base mat 11, as keeping the valve disk 60 at the reference position of FIG. 15. While the base mat 11 is kept inflated by the compressed air, the inside air of the base mat 11 is allowed to outflow through minute perforations 12 in the upper sheet of the base mat 11 to provide a gentle air flow at such a limited rate as to keep the base mat 11 inflated by the compressed air continuously supplied from the pump 30. The resulting air flow acts to pass around the user's body lying on the mat assembly 10 for removing perspiration of the user or applying warm air when the heater 18 is turned on, thus assuring comfortable sleep in all seasons. While inflating the base mat 11, the pressure sensor 34 constantly monitors the pressure level of the compressed air as indicative of the internal pressure of the base mat 11, and outputs a signal indicative thereof to the control circuit 70. The control circuit 70 acknowledges an instantaneous pressure level as well as a changing rate thereof and process such data in order to predict a pressure level PR expected to reach subsequently. Thus obtained predicted pressure level PR is then compared with a pressure level PS which is selected at the remote controller by the user from a preset range, for example, 60 to 120 mmHg, in order to adjust the cushioning strength which the base mat 11 provides. When the predicted pressure level PR is greater than the selected pressure level PS by a tolerable limit , for example, 5 mmHg ($PR > pS + 5$), the control circuit 70 instructs to lower the pump capacity by one step to thereby decrease the pressure level of the compressed air supplied to the base mat 11. When, on the other hand, the predicted pressure level PR is smaller than the instantaneous pressure level PS by the tolerable limit, ($PR < PS - 5$), the control circuit 70 instructs to raise the pump capacity by one step to thereby increase the pressure level of the compressed air. Otherwise, when the predicated pressure level PR is within a tolerable limit from the selected pressure level PS, the control circuits 70 allows the pump 30 to keep operating without changing the capacity. Irrespective of that the pump capacity is changed or not, the control circuit 70 waits for a predetermined time interval, for example, 15 seconds before it again compares the predicated pressure level PR with the selected pressure level PS. Thus, the base mat 11 is kept at the selected pressure level by repeating the above comparison cycle. During this cycle, the control circuit 70 counts to determine as to whether 30 minutes has elapsed after the previous calibration. If so, the pressure sensor 34 is again calibrated in order to effect exact pressure control. It is noted at this time that, as explained hereinbefore with reference to FIGS. 7 and 8, the base mat 11 can be free from undue swelling by the combination effect of the suspension ribs 13 and the backing fabric 16 of the covering 14 and present a comfortable cushioning effect with a desired strength selected by the user.

1-2 Active Rest Mode

Figure 21:
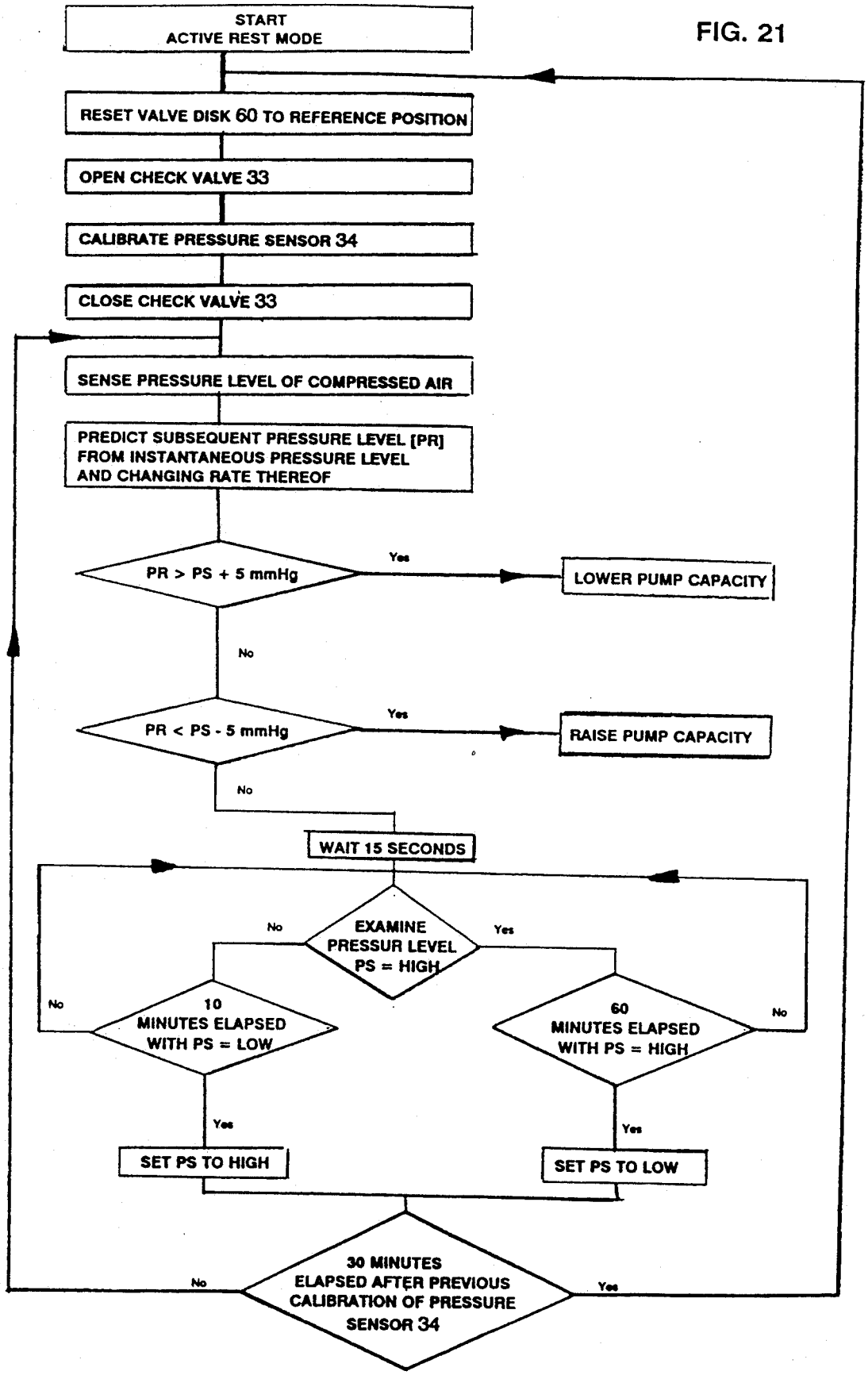
Figure 22:
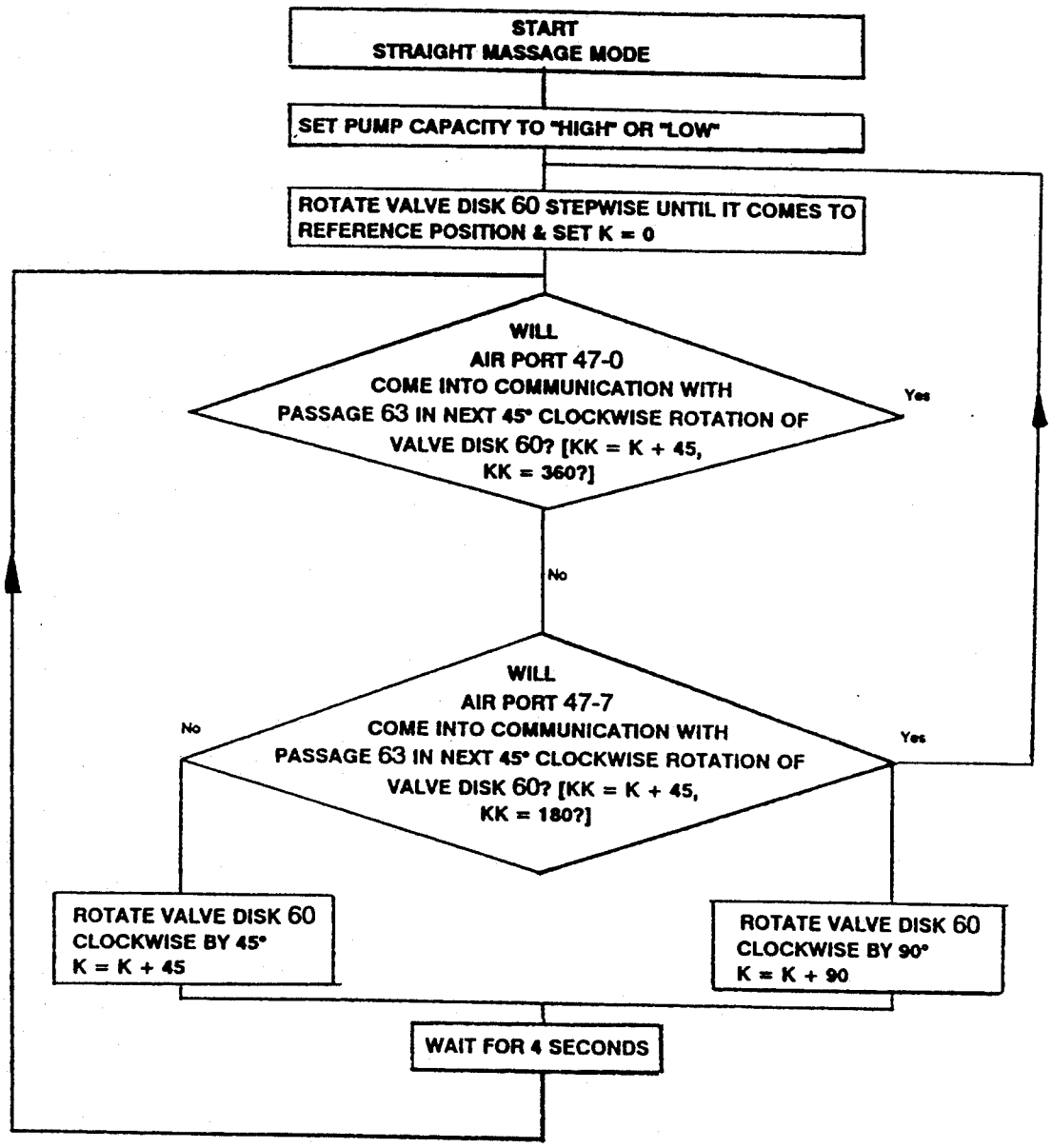
FIGS. 22 to 27 are flow charts respectively for illustrating straight and several advanced operation modes of the air bags.
Figure 23:
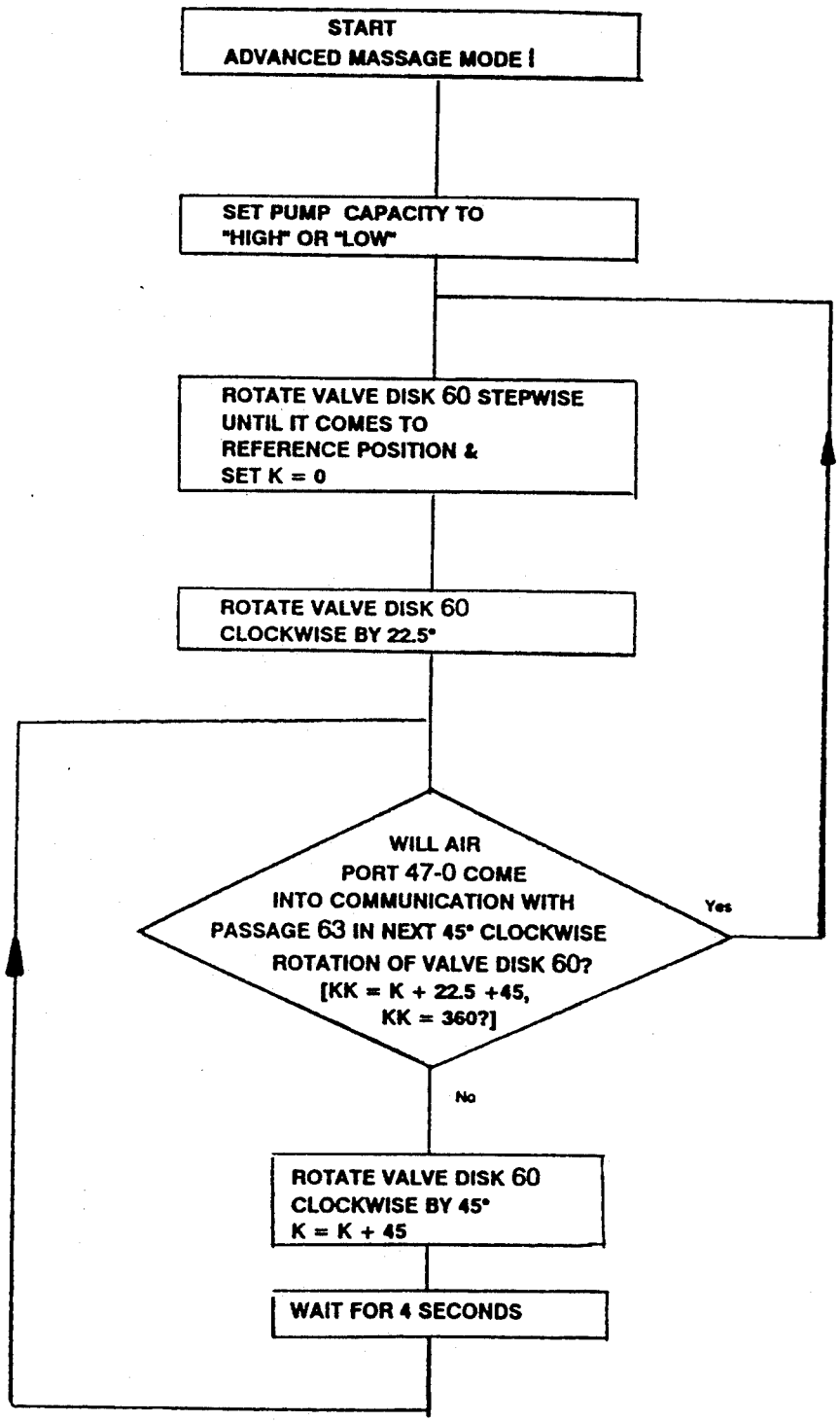
Figure 24:
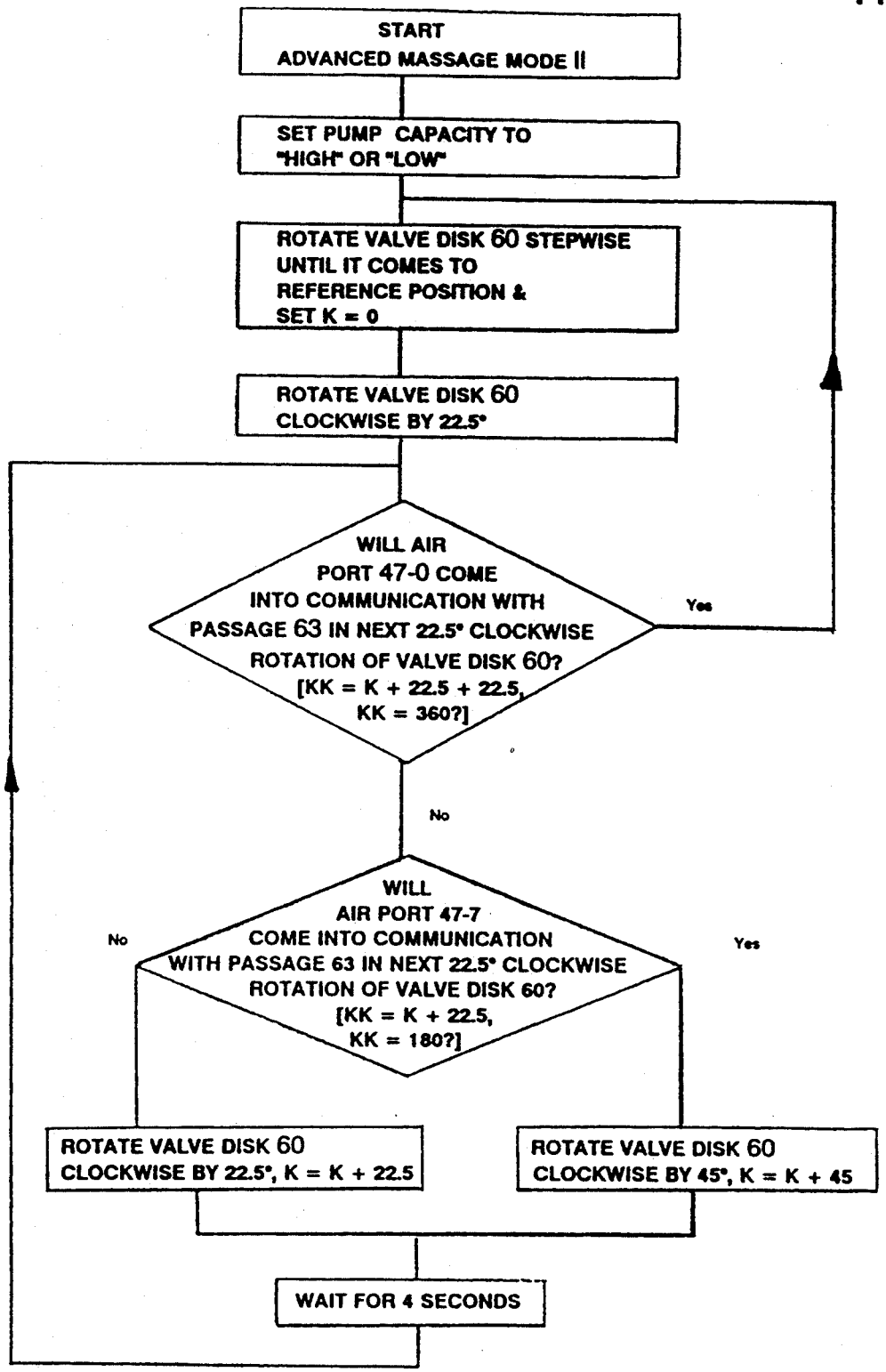
Figure 25:
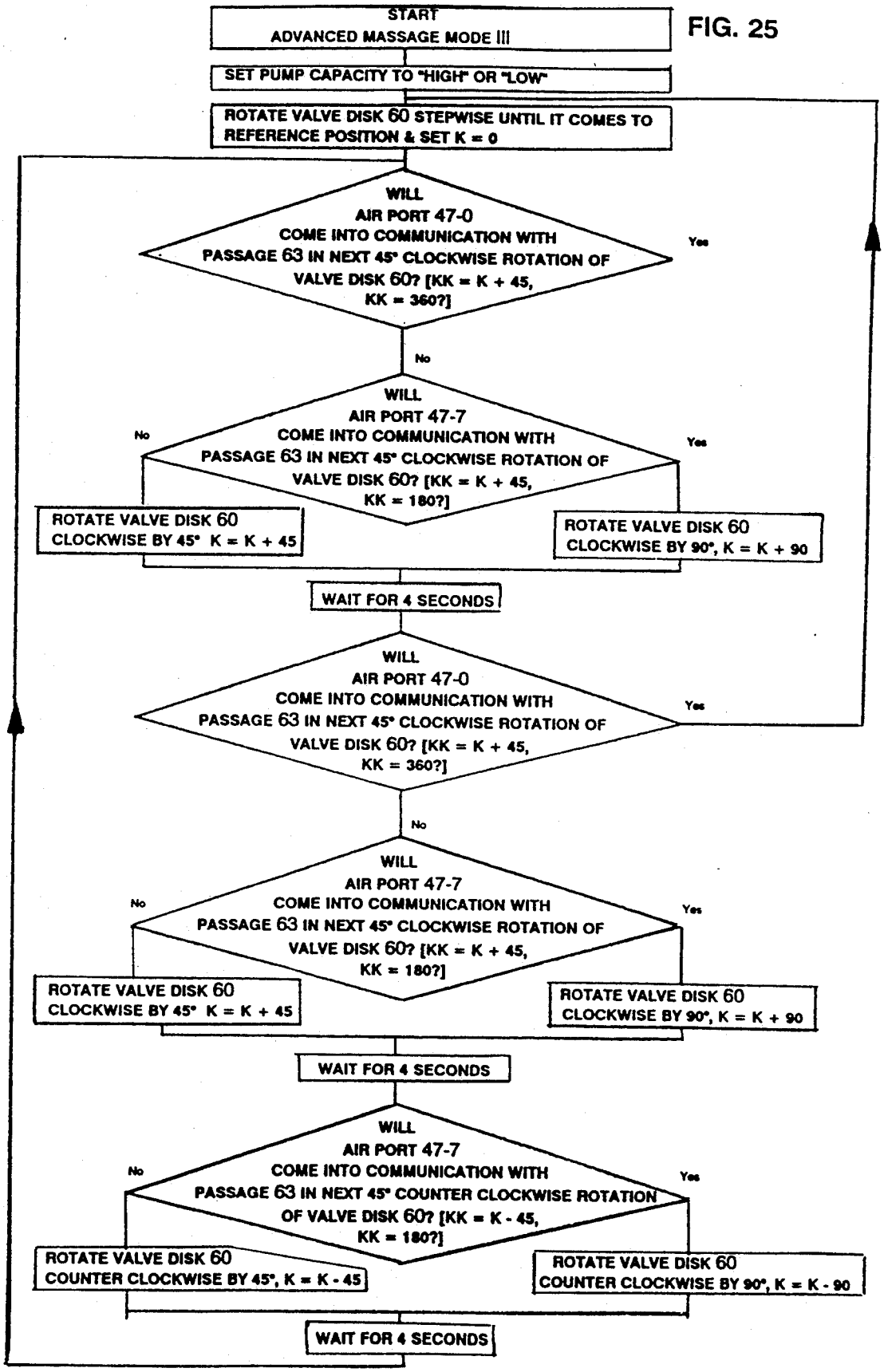
Figure 26:
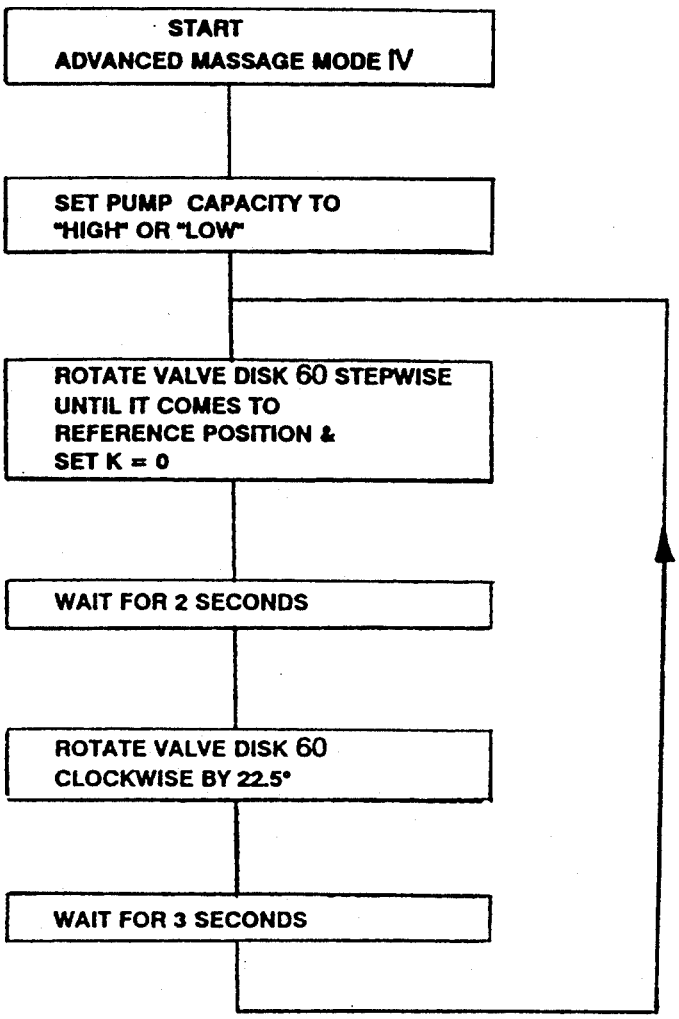

When this mode is selected, the control circuit 70 operates to repeat inflating the base mat 11 at a high pressure level for a relatively long time interval alternating by inflating at a low pressure level for a relatively short time interval. The high pressure level corresponds to the pressure level PS selected by the user and the low pressure level is set to be about 50% of the high pressure level. For internal processing in the control circuit 70, the pressure level PS is defined to designate the high pressure level when the high pressure inflation is requested [PS = the user's selected pressure level] and also defined to designate the low pressure level when the low pressure inflating is requested [PS=0.5×PS]. As shown in FIG. 21, the operation sequence of this mode includes the same steps to maintain the pressure level of the compressed air at the pressure level PS [which is initially the high pressure level] as in the inactive rest mode of FIG. 20. A decision step is appended to see whether the high pressure inflating is currently effected [PS=High ?]. This step is followed by individual steps, one for checking whether a certain time interval, e.g., 60 minutes have elapsed since the pressure level is set to the high pressure level and the other for checking whether a certain time interval, e.g., 10 minutes have elapsed since the pressure level is set to the low pressure level. When 60 minutes have elapsed in the high pressure inflation, the pressure level PS is set to the low pressure level [PS=Low] after which a routine goes back to the cycle of keeping the low pressure level PS. When 10 minutes have elapsed in the low pressure inflation, the pressure level PS is set to the high pressure level [PS=High] after which a routine goes back to the cycle of keeping the high pressure level PS. A like calibration check is included to assure exact pressure control. Thus, the base mat 11 can vary the internal pressure periodically between high to low levels in such a manner as to keep the high pressure inflation for 60 minutes alternated by 10 minutes low pressure inflation. During the high pressure inflation, the base mat 11 provides a strong cushioning effect to support the user's body without causing considerable sinking of the particular portions such as waist which would result in unnatural bending of the spine. On the other hand, during the low pressure inflation, the base mat 11 provides a soft cushioning effect to alleviate stress concentration on the back of the user's body. Thus, the repetitive high and low pressure inflation can assure very comfortable sleeping without causing unpleasant interruption in blood circulation or distortion of the body. The above time intervals for the high and pressure inflation may be varied externally or automatically for optimum performance. Likewise, the ratio of the high to low pressure level may be optimally changed as necessary.

2-1 Straight Massage Mode

Figure 9:
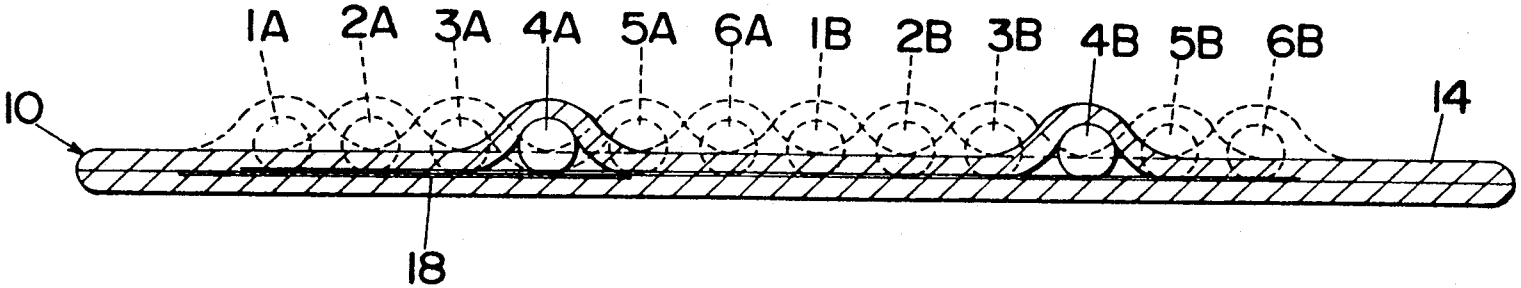
FIGS. 9 and 10 are explanatory views showing typical operation modes available by the massaging apparatus.
Figure 10:
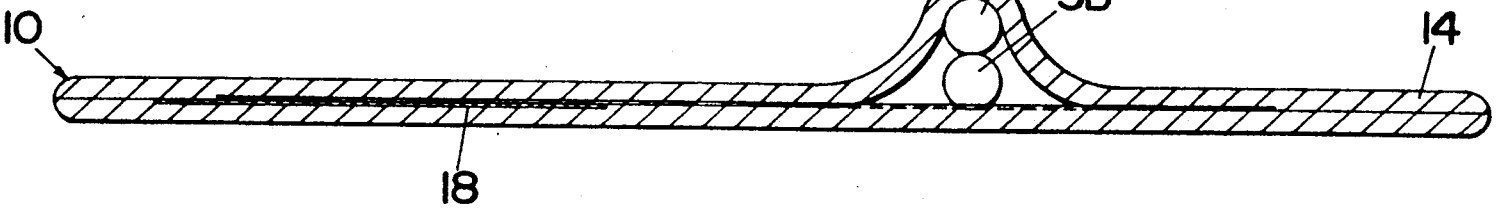
Figure 11:
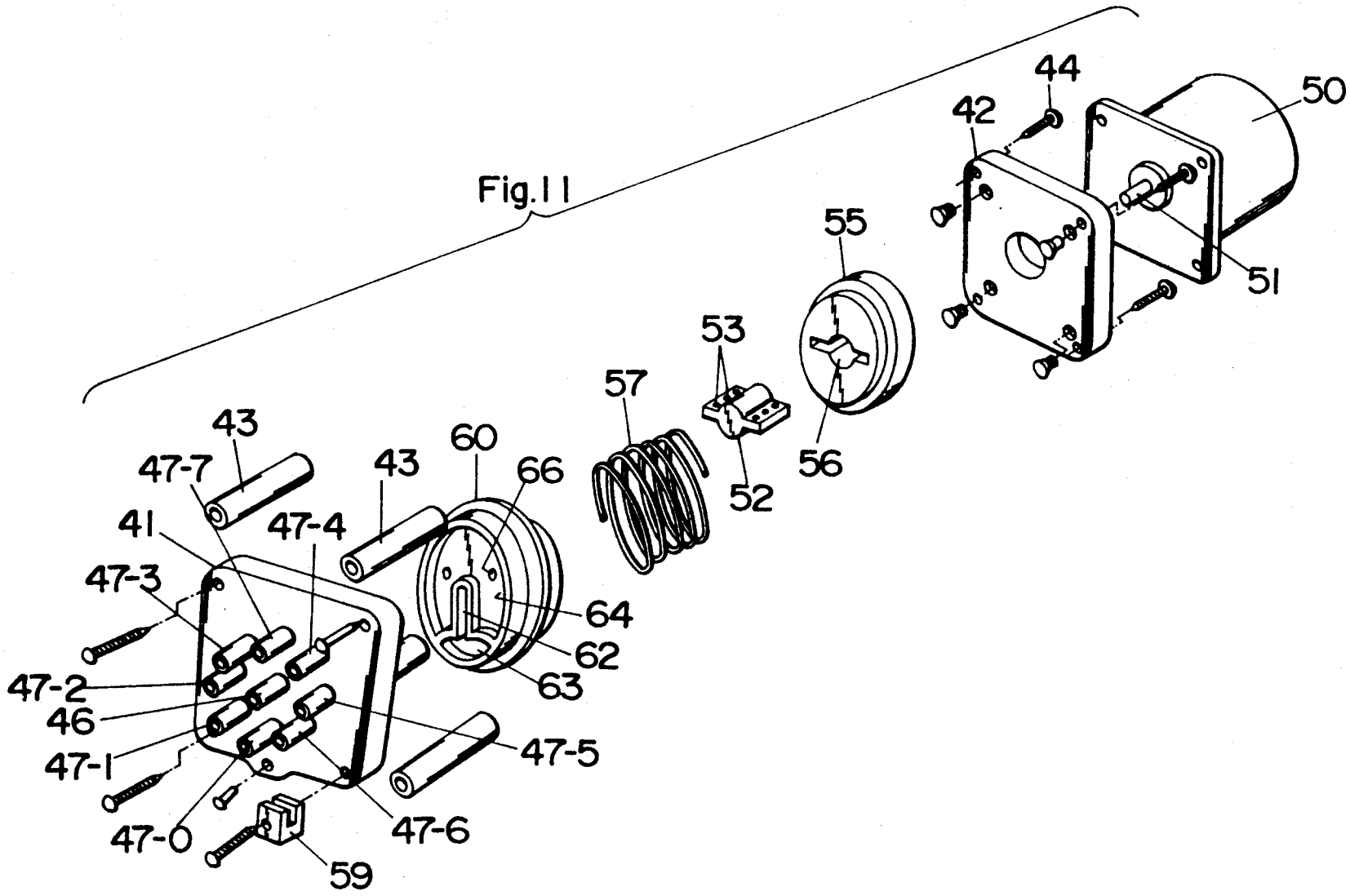
FIG. 11 is an exploded perspective view of a distributor utilized for selectively channeling compressed air to the air bags.
Figure 16A:
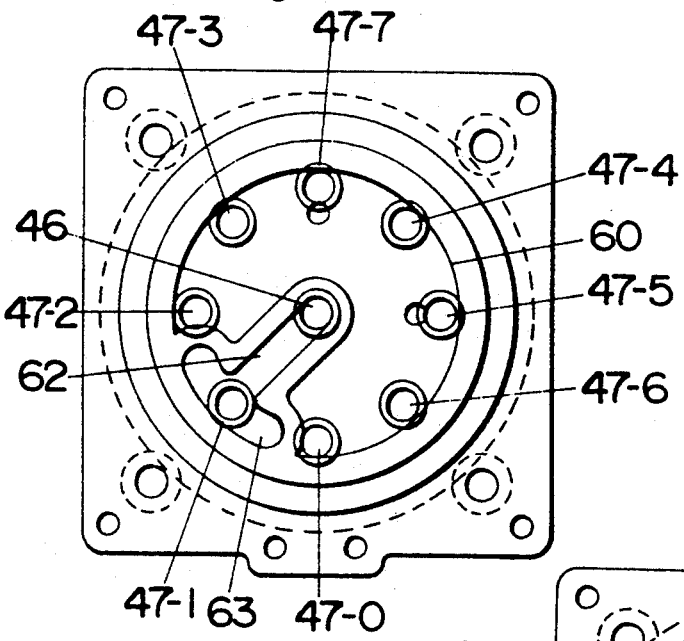
FIG. 16, composed of FIGS. 16A to 16C, is an explanatory view illustrating the distributor operation for inflating the air bags one by one in sequence.
Figure 16B:
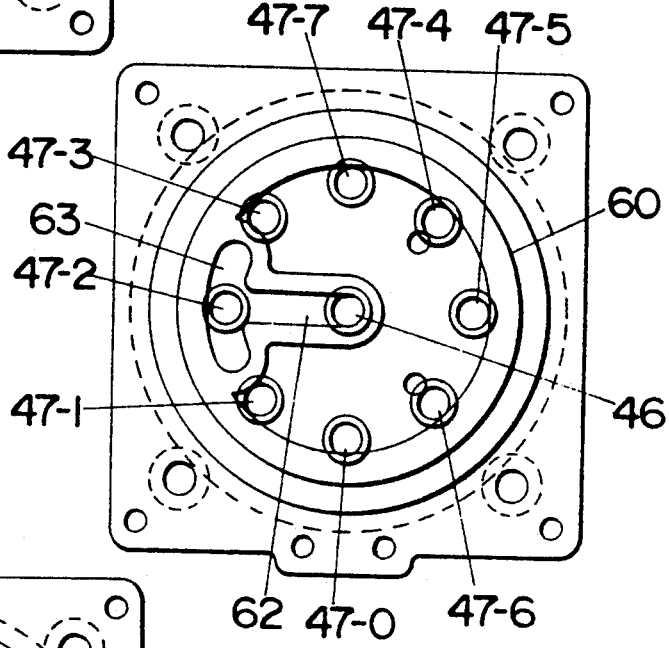
Figure 16C:
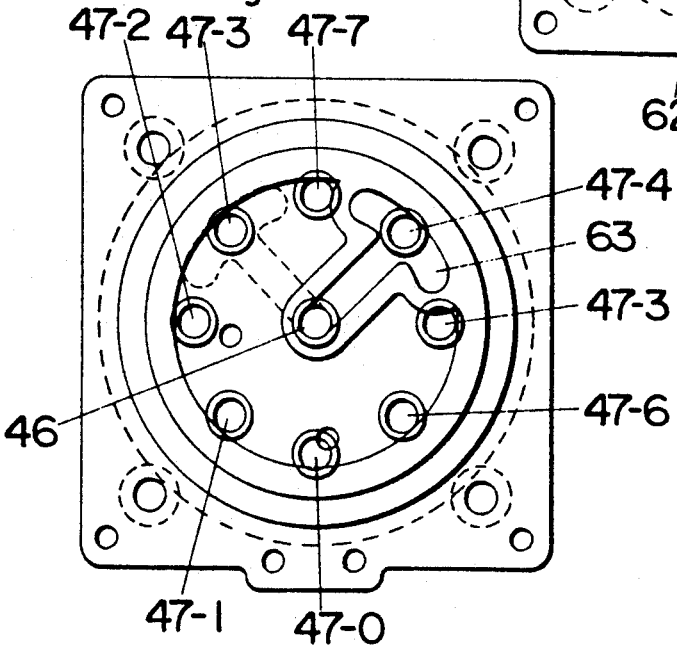

As common to the following massage modes, this mode utilizes the air bags 1A to 7A and 1B to 7B instead of the base mat 11 and selects the pump capacity either at a high or low pressure level for selectively applying the strong or weak massaging force by the air bags inflated at the high or low pressure. The base mat 11 is disabled in the massage modes and left collapsed so as not to interfere the inflating massaging action of the air bags. As shown in the flow chart of FIG. 22, the straight massage mode commences to set the pump capacity to high or low in response to the user's selection of this mode at the remote controller 80. Thereafter, the control circuit 70 operates to rotate the valve disk 60 in the clockwise direction as viewed in FIGS. 16A to 16B until it comes into the reference position where the passage 63 is in communication with the air port 47-0. Then, the valve disk 60 is temporarily stopped at this reference position and the control circuit 70 responds to set an angle parameter K to zero (K=0) as representative of relative angular disposition of the valve disk 60 about the rotation axis at this reference position. A step follows to examine as to whether the passage 63 will come into communication with the air port 47-0 when the valve disk 60 rotates in the clockwise direction in the figures by an angular displacement of 45°. That is, the control circuit 70 sets another angular parameter KK to be K plus 45 (KK=K+45) for examination of whether KK=360. If KK=360, which means that the valve disk 60 is at a position where the passage 63 is in communication with the air port 47-6 immediately preceding to the air port 47-0, a routine goes back to the previous step. Otherwise, i.e. KK<>360, then it is examined whether the passage 63 will come into communication with the air port 47-7 when the valve disk 60 rotates in the clockwise direction further by an angular displacement of 45° (KK=180). If no, which means that the passage 63 is currently not in communication with the air port 47-3, the valve disk 60 is allowed to rotate clockwise by 45°, for instance, to bring the passage 63 into communication with the air port 47-1, as shown in FIG. 16A. At this time, the control circuit 70 increments the angular parameter K by such value [K=K+45]. The valve disk 60 is held at this position for a predetermined time interval, e.g. 4 seconds,thereby inflating the associated air bags 1A and 1B promptly and simultaneously by the compressed air supplied through the air ports 47-1 from the pump 30. Thereafter, the valve disk 60 is driven to rotate stepwise in the clockwise direction by 45° through the above steps to bring the passage 63 into communication with the air port 47-2 and then into communication with the air port 47-3, thereby inflating the air bags 2A and 2B, 3A and 3B in sequence, as shown FIGS. 16B and 16C. When the valve disk 60 comes into the position where the passage 63 is in communication with the air port 47-3, the control circuit 70 acknowledges that the passage 63 will come into communication with the air port 47-7 in the next stepwise rotation of the valve disk 60 from the relation that KK=180. Then, a routine proceed to another step to rotate the valve disk 60 stepwise in the clockwise direction by 90°, as shown in FIG. 16C, and increment the angular parameter correspondingly [K=K+90]. The valve disk 60 is held for 4 seconds at this position where the passage 63 is in communication with the air port 47-4 to inflate the associated air bags 4A and 4B. In this manner, the distributor 40 is controlled to repeat a cycle of allowing the compressed air to outflow through the air ports in the order of 47-1, 47-2, 47-3, 47-4, 47-5, and 47-6 for sequentially inflating the associated air bags 1A-1B, 2A-2B, 3A-3B, 4A-4C, 5A-5B, and 6A-6B. It is noted in this connection that, during the above stepwise rotation of the valve disk 60, the air port 47-0 comes into communication only temporarily with the passage 63 such that the compressed air is not permitted to be distributed for inflating the base mat 11. Further, as known from FIGS. 16A to 16C, the air ports, which are not currently in communication with the passage 63, are brought into communication with the chamber 64 of the valve disk 60 so that the compressed air is allowed to escape from the corresponding air bags through the chamber 64 and the exhaust ports 66 into the open air, thereby collapsing those air bags. In other words, the inflation advances in the lengthwise direction of the mat assembly in such a manner as to inflate one pair of the spaced air bags at a time while keeping the other pairs of the air bags collapsed, as shown in FIG. 9, for massaging the back of the user's body along its length, i.e., from the feet to the shoulders or neck. When it is required to provide the air flow through the minute perforations 12 out of the base mat 11 for cooling the user, the valve disk 60 can be controlled to be kept at the reference position for a certain time interval to partially inflate the base mat 11.

2-2 Advanced Massage Mode I

Figure 17:
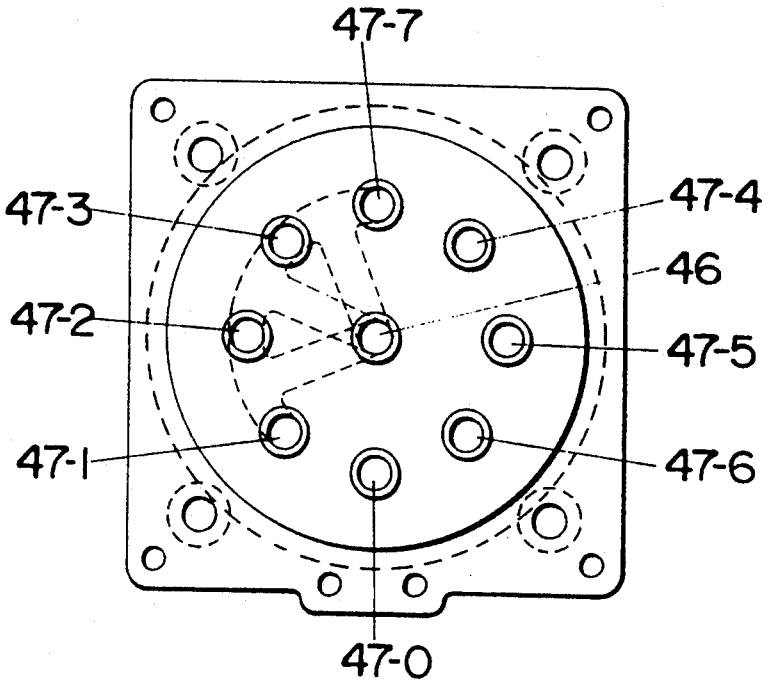
FIG. 17 is an explanatory view illustrating the distributor operation of inflating the air bags in sequence with the two adjacent air bags inflated at a time.

This mode effects to inflate the two adjacent ones of the air bags simultaneously in each group so as to repeat a cycle of sequentially inflating the air bags in the order of 1A and 2A, 2A and 3A, 3A and 7A, 7A and 4A, 4A and 5A, and 5A and 6A (1B and 2B, 2B and 3B, 3B and 7B, 7B and 4B, 4B and 5B, and 5B and 6B). The operation sequence of this mode is shown in the flow chart of FIG. 23. After the valve disk 60 is reset to the reference position to communicate the passage 63 with the air port 47-0, it is rotated clockwise by 22.5° into a position of communicating the passage 63 simultaneously with the two adjacent air ports, as shown in FIG. 17. Then, the angular position of the valve disk 60 is examined as to whether the passage 63 will come into communication with the air port 47-0 when the valve disk 60 rotates in the clockwise direction further by an angular displacement of 45°. That is, KK is set to be K plus 22.5+45 for examination of whether KK=360. If KK<>360, which means that the valve disk 60 is currently not in the position of communicating the passage 63 simultaneously with the air port 47-5 and 46-6, the valve disk 60 is controlled to rotate clockwise by 45° [K=K+45] and is held at the position for 4 seconds to inflate the associated air bags. When the valve disk 60 comes into the position where the passage 63 is in communication simultaneously with the air ports 47-5 and 47-6, it is kept in this position for 4 seconds to inflate the associated bags 5A and 6A (5B and 6B) simultaneously. At this occurrence, the control circuit 70 acknowledges the angular disposition of the valve disk 60 from KK=360 so that the valve disk 60 is to be rotated back to the reference position. Thereafter, the same inflating procedure is repeated in the above sequence.

2-3 Advanced Massage Mode II

Figure 18:
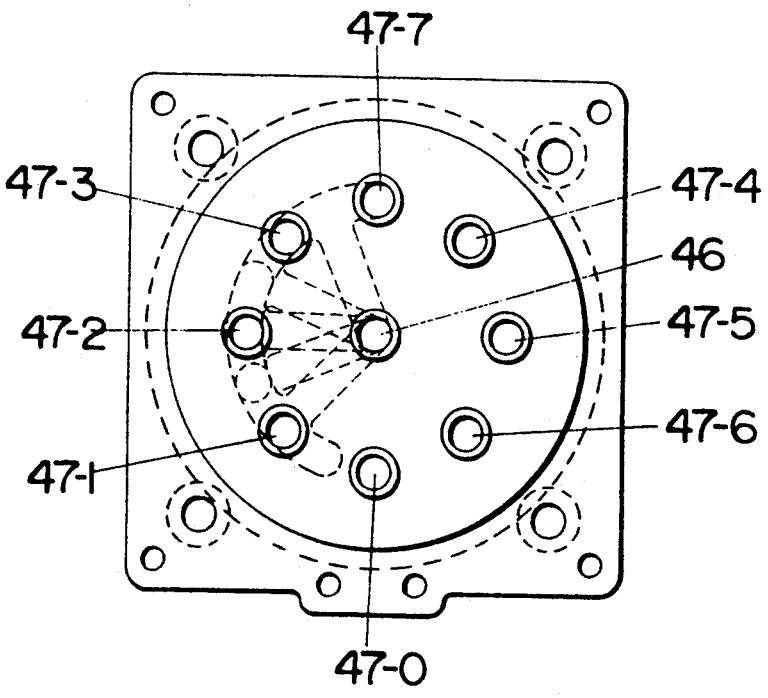
FIG. 18 is an explanatory view illustrating the distributor operation of inflating the air bags in sequence for inflating one air bags alternated by inflating two air bags.

This mode enables to inflate a single air bag followed by inflating two adjacent air bags simultaneously in each group of the air bag arrangement. That is, the distributor 40 is controlled to effect an inflation cycle of sequentially inflating the air bags in the order of 1A, 1A and 2A, 2A, 2A and 3A, 3A, 3A and 7A, 4A, 4A and 5A, 5A, 5A and 6A, and 6A (1B, 1B and 2B, 2B, 2B and 3B, 3B, 3B and 7B, 4B, 4B and 5B, 5B, 5B and 6B, and 6B). The operation sequence of this mode is shown in the flow chart of FIG. 24. As known from the flow chart, the valve disk 60 is basically rotated clockwise by 22.5°, as shown in FIG. 18. Only exception is that it is rotated clockwise by 45° from the position where the passage 63 is communicated concurrently with the air port 47-3 and 47-7 to the position where the passage 63 is communicated with the air port 47-4 only.

2-4 Advanced Massage Mode - III

This mode enables to inflate the air bags partly in a reciprocating manner to apply a kneading massage action to the user's body. That is, as shown in the flow chart of FIG. 25, the valve disk 60 is controlled to basically rotate in a reverse or counterclockwise direction, as viewed in FIGS. 16A to 16C, by one step each time after the valve disk 60 rotates in the forward or clockwise direction by three steps followed by again rotate in the forward or clockwise direction. Whereby, the distributor 40 effects to repeat a back and forth cycle of sequentially inflating the air bags in the order of 1A-2A-1A, 2A-3A-2A, 3A-4A-3A, 4A-5A-4A, 5A-6A-5A, and 6A (1B-2B-1B, 2B-3B-2B, 3B-4B-3B, 4B-5B-4B, 5B-6B-5B, and 6B). As known from the flow chart, the air bags 7A and 7B are not available in this mode as the valve disk 60 is controlled to have the passage 63 jumping over the corresponding air port 47-7 to move between the air ports 47-3 and 47-4. Likewise, the passage 63 jumps over the air port 47-0 when moving from the air port 47-6 to the air port 47-1.

2-5 Advanced Massage Mode IV

Figure 19A:
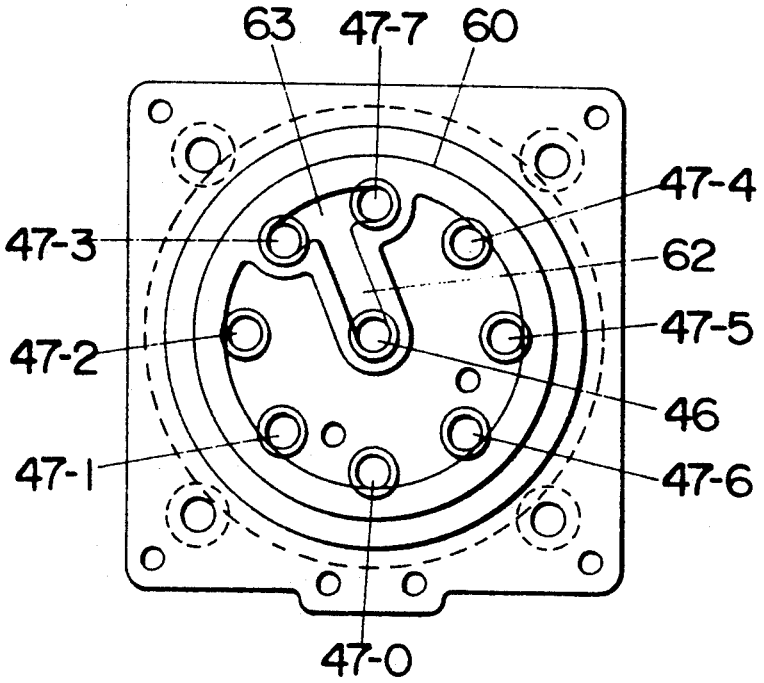
FIG. 19, composed of FIGS. 19A and 19B, is an explanatory view illustrating the distributor operation for inflating the air bags for waist massage.
Figure 19B:
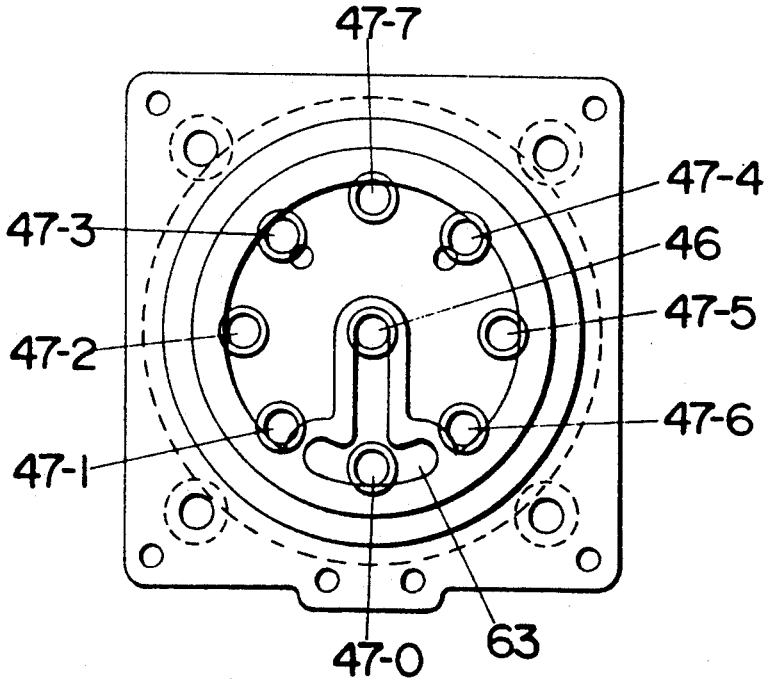

This mode is provided to apply an intensive massage to legs and waist of the user's body by simultaneously inflating the stacked pairs of the air bags 3A and 7A (3B and 7B) defining the leg and waist massage sections, respectively. As shown in the flow chart of FIG. 26, after the valve disk 60 is rotated to the reference position, it is kept for 2 seconds in order to supply the compressed air to partially inflate the base mat 11. Subsequently, the valve disk 60 is controlled to rotate clockwise, as shown in FIGS. 19A and 19B, by 137.5° to bring the passage 63 into communication simultaneously with the air ports 47-3 and 47-7 and is held at this position for 3 seconds for inflating the associated air bags 3A and 7A (3B and 7B), after which the valve disk 60 is moved back to the reference position, permitting the air bags to collapse while again inflating the base mat 11. Thus, the valve disk 60 is controlled to repeat a cycle of inflating and collapsing the air bags 3A and 7A (3B and 7B) to apply the intense massage to the legs and the waist. It is noted in this connection that the base mat 11 is inflated partially to such an extent that the air is allowed to outflow through the minute perforations 12 when the air bags are being collapsed, thereby exposing the user to the resulting gentle air flow for removing perspiration or adding comfortable refreshing effect to the massage action.

2-6 Advanced Massage Mode V

Figure 27:
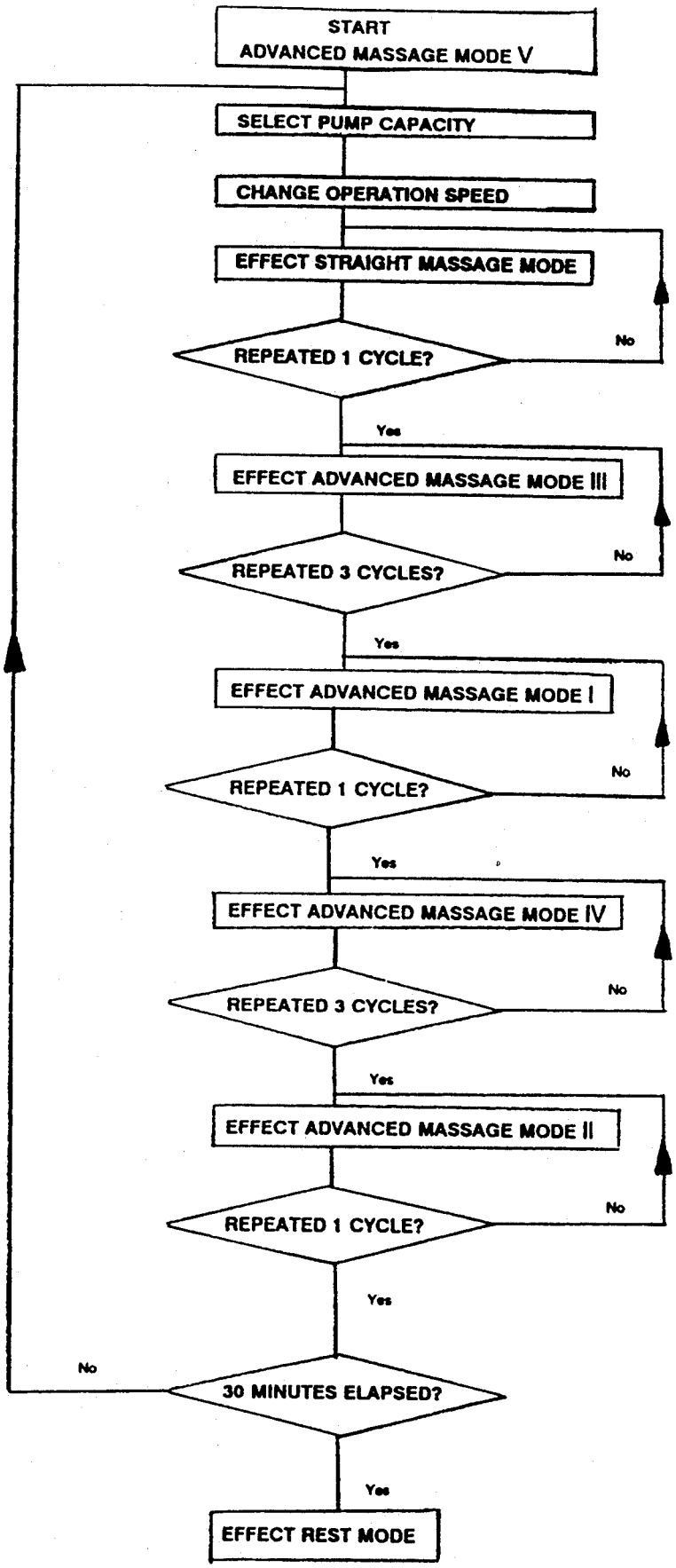

This mode combines the above mentioned modes in a suitable pattern, as shown in the flow chart of FIG. 27. As seen in the figure, the mode allows to change an operation speed at which the air bags are sequentially inflated, independently of the pump capacity selected at a previous step or the pressure level of the air bags. If no change is made, the pump capacity and the operation speed is automatically set to the previously selected or default ones, respectively. Thereafter, the sequence proceeds to effect the above straight massage mode for one cycle, the advanced massage mode III for 3 cycles, the advanced massage mode I for one cycle, the advance massage mode IV for 3 cycles, and the advanced massage mode II for one cycle in this order. When 30 minutes has elapsed from the start of the operation, the sequence goes to one of the above inactive and active rest modes which has been selected by the user in the previous operation. When no rest mode has been selected in the previous operation, the inactive rest mode is designated to be performed.

Second embodiment <FIGS. 28 to 45>

Figure 28:
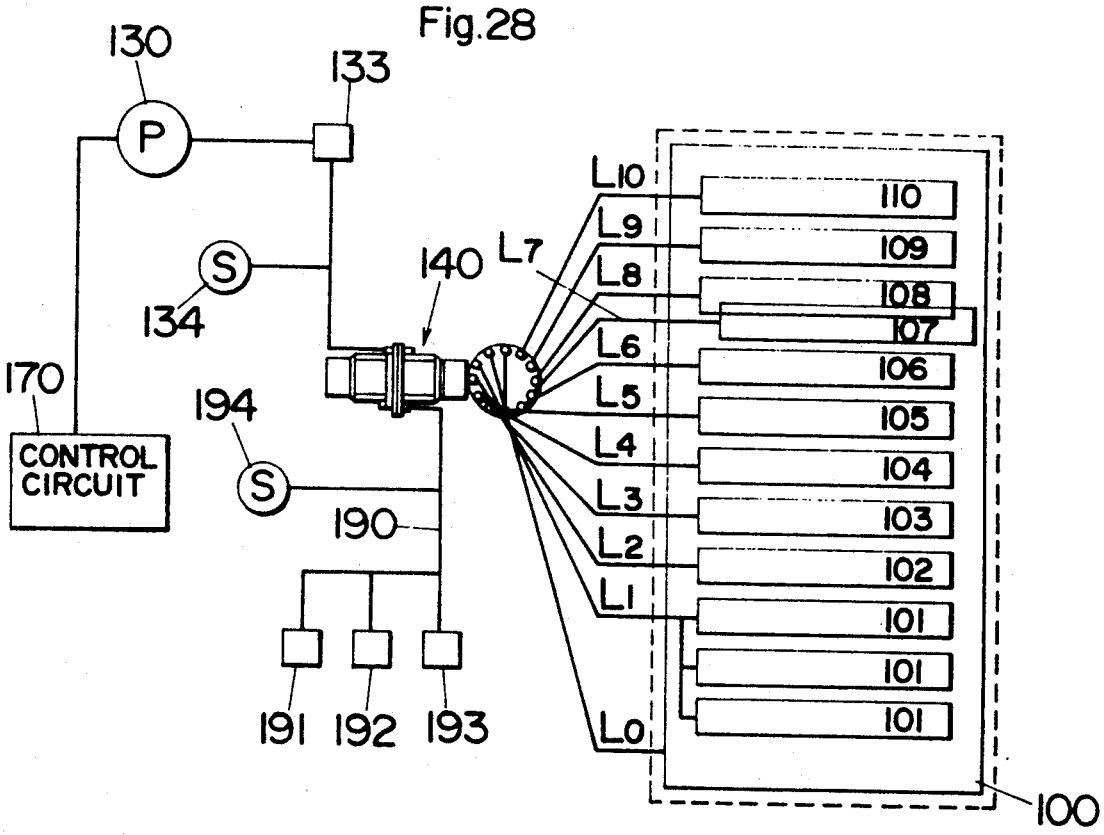
FIG. 28 is a schematic control diagram of an air massaging apparatus in accordance with a second embodiment of the present invention.

Referring to FIG. 28, there is shown an air massaging apparatus in accordance with a second embodiment of the present invention. The system configuration is basically identical to that of the first embodiment except that a combination distributor 140 is utilized for separate control of feed-in and feed-out of the compressed air to and from a base mat 100 and air bags 101 to 110.

The air bags 101 to 110 are arranged in side-by-side relation on the base mat 100 along the length wise dimension thereof. Three consecutive air bags 101 disposed on the foot end of the base mat 100 are collectively coupled to a single air port of the distributor 140, while the nine other air bags 102 to 110 are coupled respectively to different air ports 140, and the base mat 100 is coupled to another single air port the distributor 140. A pump 130 is connected to supply compressed air to intake ports 146A of the distributor 140 through a pump line 131 with an inlet valve 133 and a pressure sensor 134. The pump 130, the inlet valve 133 and the sensor 134 are coupled to a control circuit 170 to be controlled and monitored thereby. Extending from distributor 140 is an exhaust line 190 which terminates in three parallel outlet valves 191 to 193 to be open and closed by the control circuit 170. The exhaust line 190 has another pressure sensor 194 for sensing the pressure level of the air flowing through the distributor 140 out of the air bags 101 to 110 or the base mat 100.

Figure 29:
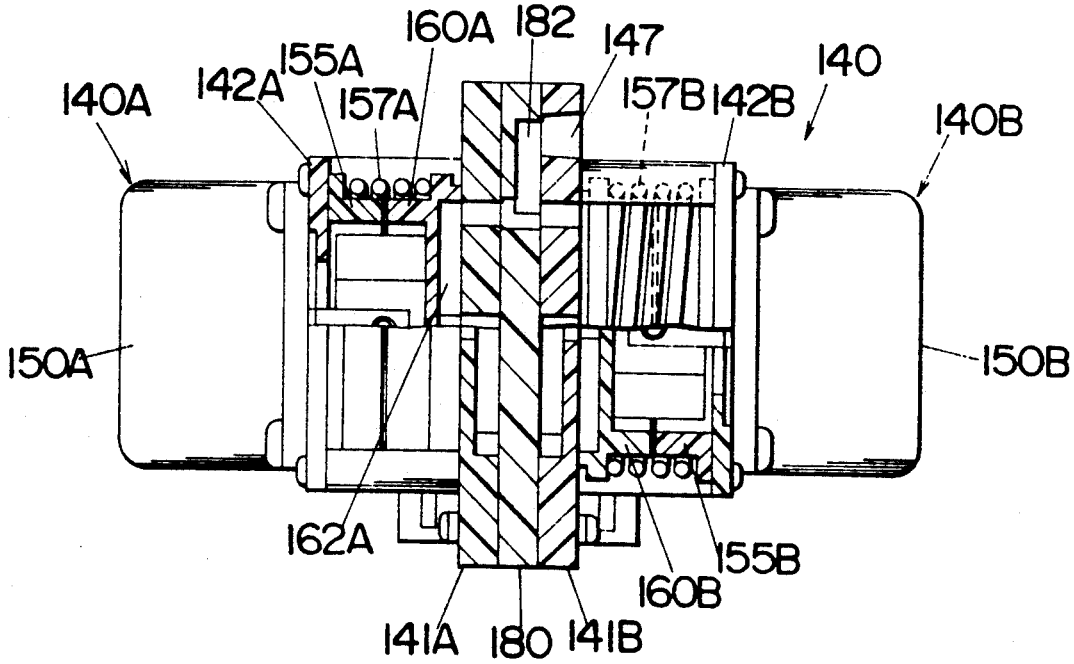
FIG. 29 is an elevation partly in section of a distributor assembly utilized in the apparatus of FIG. 28.
Figure 30:
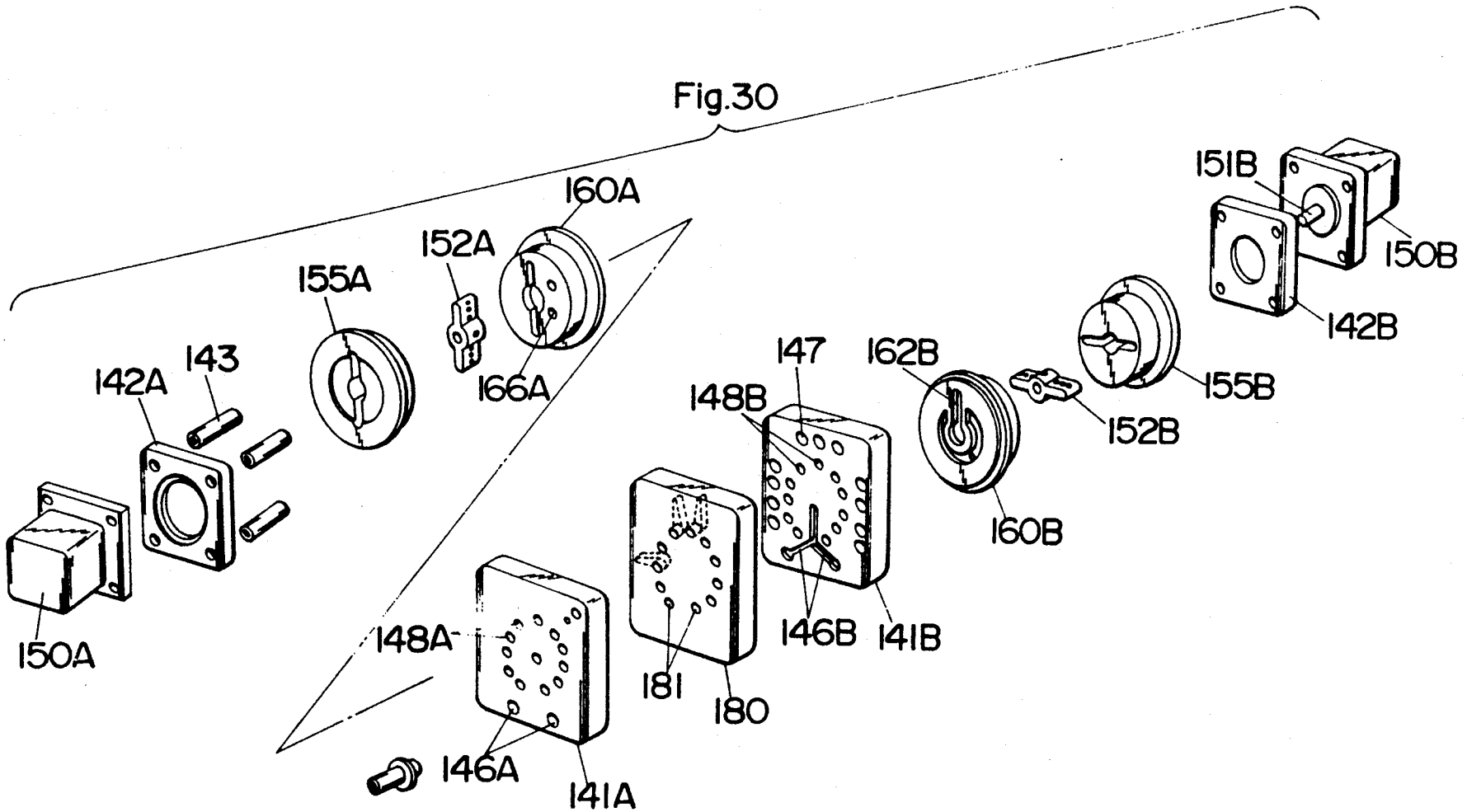
FIG. 30 is an exploded perspective view of the distributor assembly.
Figure 31:
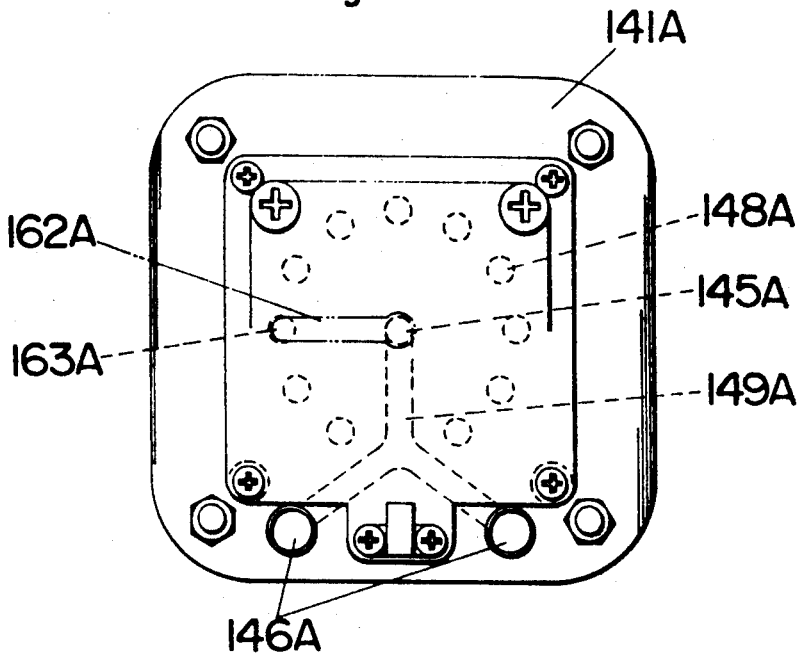
FIGS. 31 and 32 are side views of the distributor assembly respectively as viewed from the opposite directions.
Figure 32:
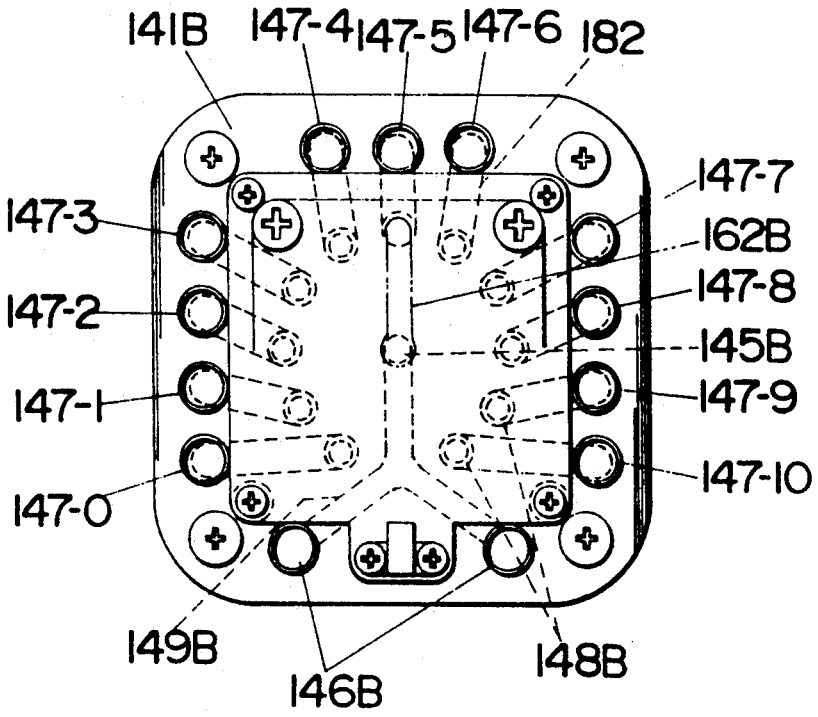

As shown in FIGS. 29 and 30, the distributor 140 comprises an intake distributor 140A and an exhaust distributor 140B each including a stepper motor 150A (150B) mounted On a mount plate 142A (142B), a valve disk 160A (160B), a sleeve 155A (155B), a vane point 152A (152B) coupling an output rotor shaft of the stepping motor to the valve disk. The intake distributor 140A further includes an intake valve plate 141A which is secured to the mount plate 142A by means of posts 143A to accommodate therebetween the sleeve 155A and the valve disk 160A. Likewise, the exhaust distributor 140A includes an exhaust valve plate 141B secured to the mount plate 142B by means of posts 143B to accommodate therebetween the sleeve 155B and the valve disk 160B. Disposed between the intake and exhaust valve plates 141A and 141B is a channel plate 180 for channeling the compressed air selectively to and from the base mat 100 and the air bags 101 to 110. The channel plate 180 and the valve plates 141A and 141B are secured into a unitary structure with air tight sealing therebetween. The valve disk 160A and 160B are pressed against the intake and exhaust valve plates 141A and 141B respectively by means of coil springs 157A and 157B to effect air tight sealing between the contacting surfaces while being permitted to rotate relative to the plates 141A and 141B, respectively. As in the first embodiment, the coil spring 157A and 157B are each held at its rear end to the sleeve 155A and 155B rotatable together with the valve disk 160A and 160B so as to keep the sealing contact during the rotation of the valve disks 160A and 160B relative to the plates 141A and 141B.

Figure 35:
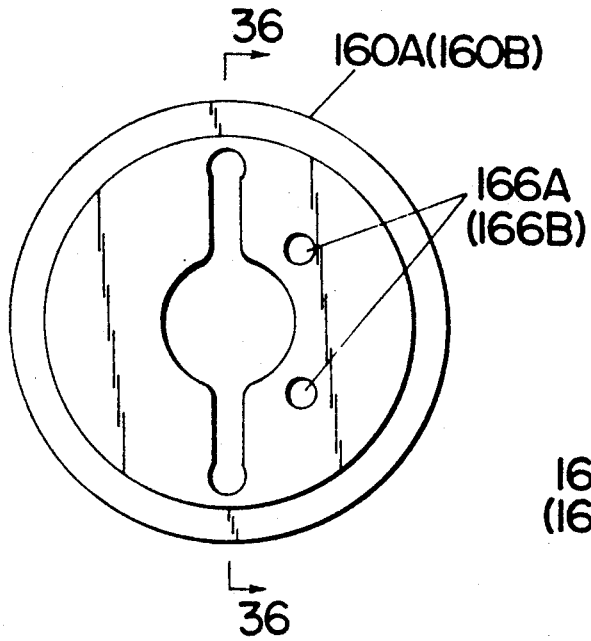
FIGS. 35 is a front view of a valve disk utilized in the distributor assembly.
Figure 36:
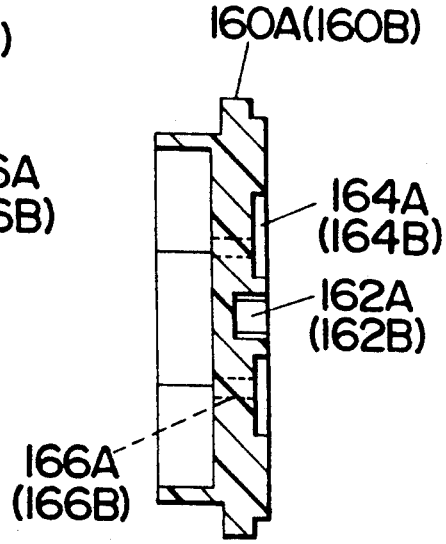
FIG. 36 is a cross section taken along line 36—36 of FIG. 35.
Figure 37:
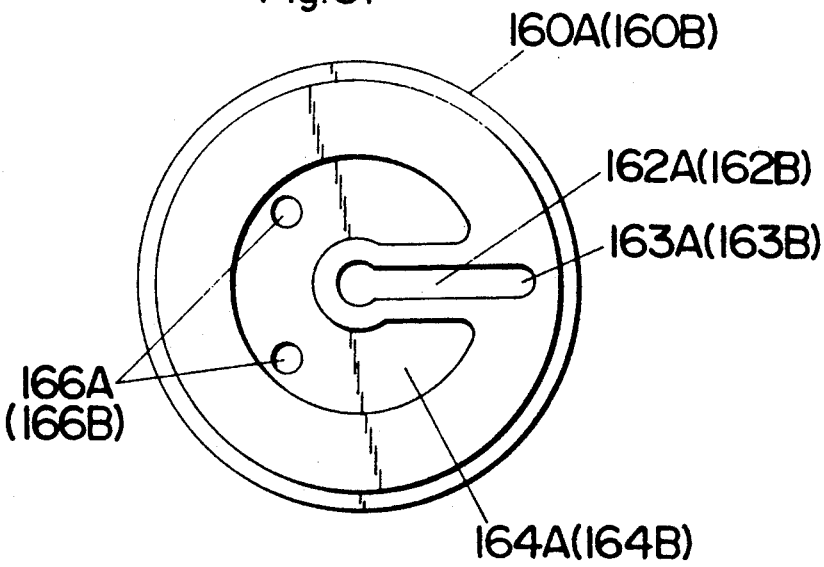
FIG. 37 is a rear view of the valve disk

The valve plates 160A and 160B are of identical configuration and, as best shown in FIGS. 35 to 37, are each formed in its contacting surface with a radial channel 162A (162B) extending outwardly from a center and terminates in a passage 163A (163B) and also with a C-shaped chamber 164A (164B) extending circumferentially about a rotation axis of the valve disk over an extended range but separated from the radial channel 162A (162B). The chamber 164A (165B) is formed with axially extending escape orifices 166A (166B) open to the rear of the valve disk 160A (160B) to provide an escape flow path for permitting the excessively compressed air to escape into the open air, which would otherwise act to move the valve disk axially away from the opposed valve plate 141A (141B) to break the air tight sealing therebetween.

Figure 38:
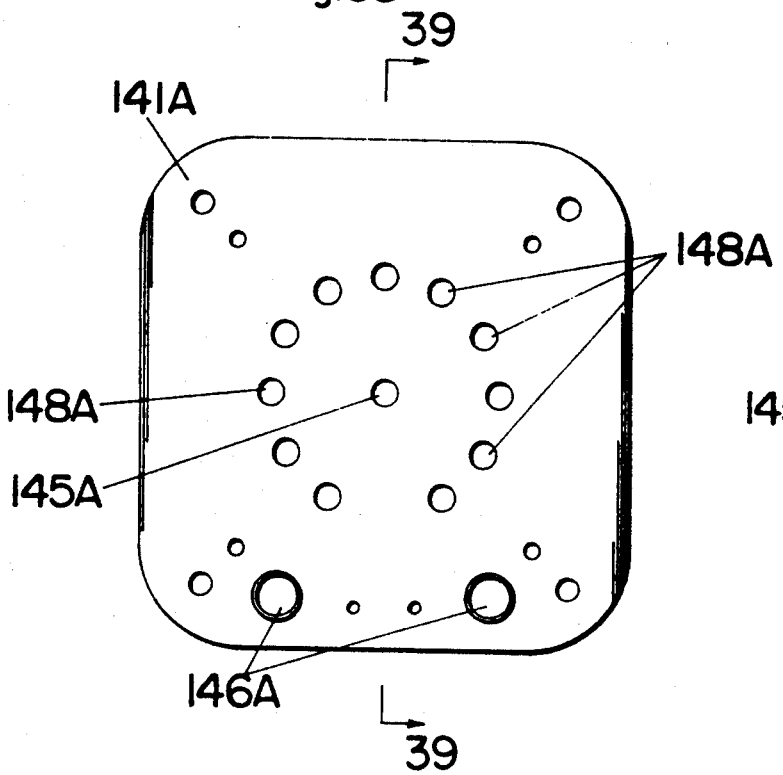
FIG. 38 is a front view of an intake valve plate utilized in combination with the valve disk.
Figure 39:
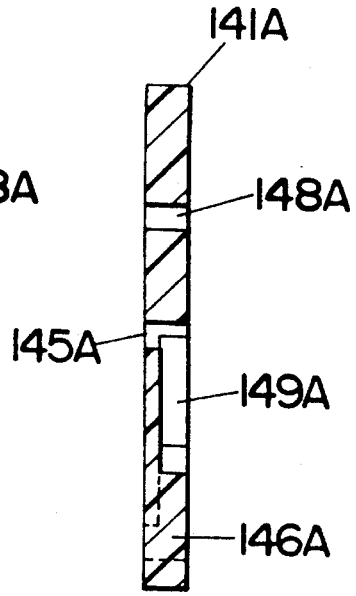
FIG. 39 is a cross section taken along line 39—39 of FIG. 38.
Figure 40:
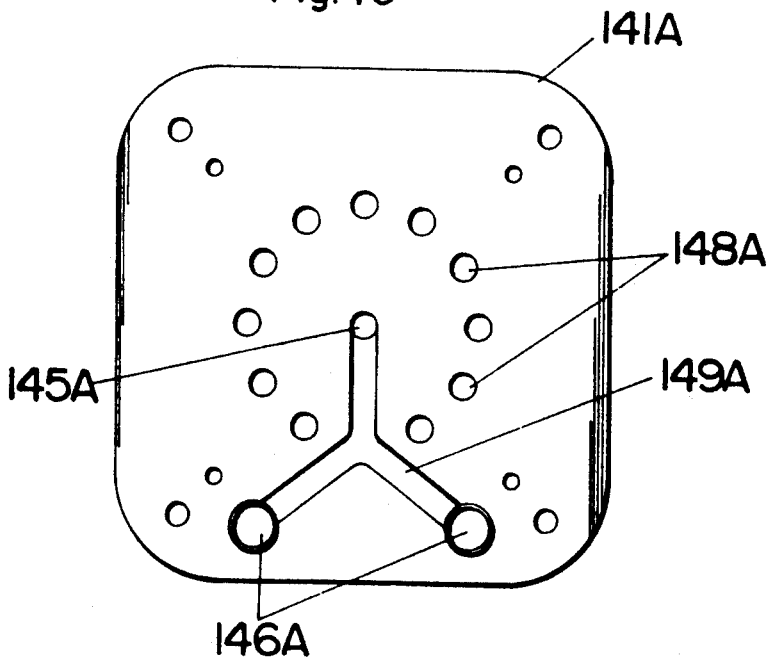
FIG. 40 is a rear view of the intake valve plate.

The intake valve disk 141A is formed, as shown in FIGS. 38 to 40, With a center through-hole 145A and circumferentially spaced eleven (11) peripheral through-holes 148A arranged about the center through-hole 145A. The intake ports 146A are provided to penetrate through the lower portion of the intake valve disk 141A and are communicated with the center through-hole 145A through a Y-shaped groove 149A formed in the front surface opposing the channel plate 180. The intake ports 146A are adapted to be connected at the ends remote from the groove 149A collectively to the pump line 131 to receive the compressed air from the pump 130.

Figure 44:
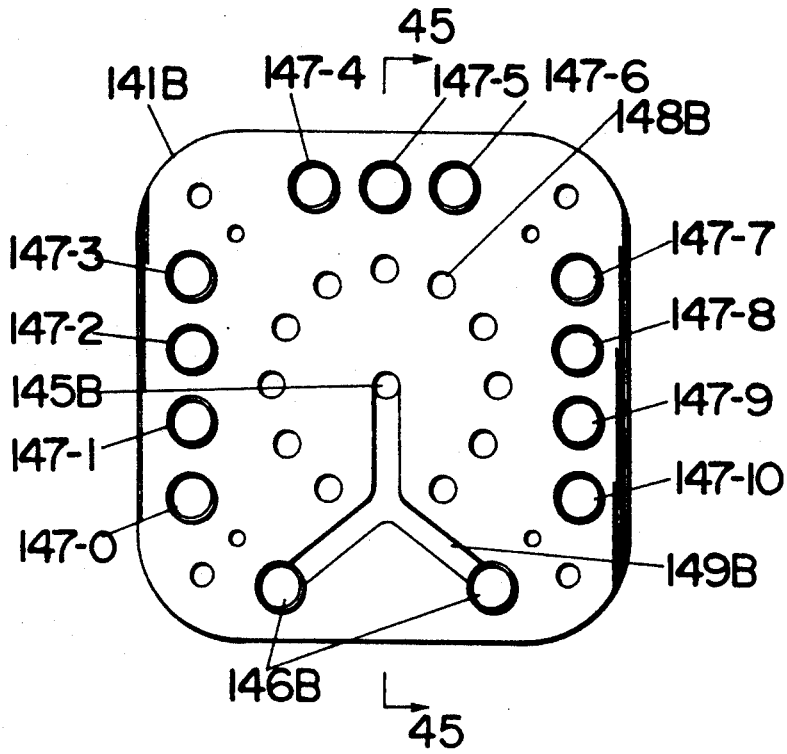
FIG. 44 is an exhaust valve plate utilized in combination with the channel plate.
Figure 45:
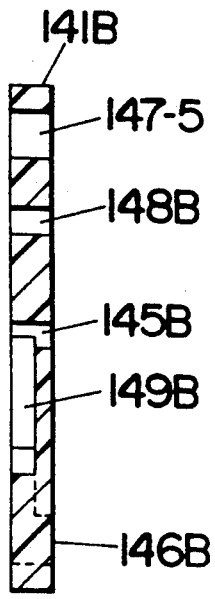
FIG. 45 is a cross section taken along line 45—45 of FIG. 44.
Figure 46:
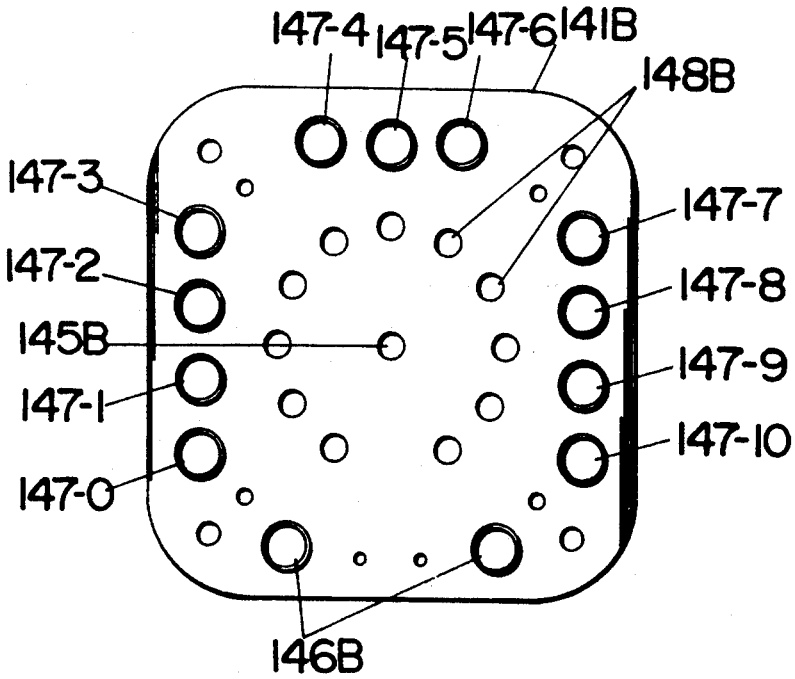
FIG. 46 is a rear view of the exhaust valve plate.

Likewise, the exhaust valve disk 141B is formed, as shown in FIGS. 44 to 46, with a center through-hole 145B and circumferentially spaced eleven (11) peripheral through-holes holes 148B arranged about the center through-hole 145B. Exhaust ports 146B are provided to penetrate through the lower portion of the exhaust valve disk 141B and are communicated with the center through-hole 145B through a Y-shaped groove 149B formed in the front surface opposing the channel plate 180. The exhaust ports 146B are adapted to be connected at the ends remote from the groove 149B collectively to the exhaust line 190 for releasing the compressed air from the base mat 100 and the air bags 101 to 110. Further, the exhaust valve disk 141B is provided with eleven air ports 147-0 to 147-10 adapted to be connected respectively through feed lines $L_0$ to $L_{10}$ to the base mat 110 and the air bags 101 to 110.

Figure 33:
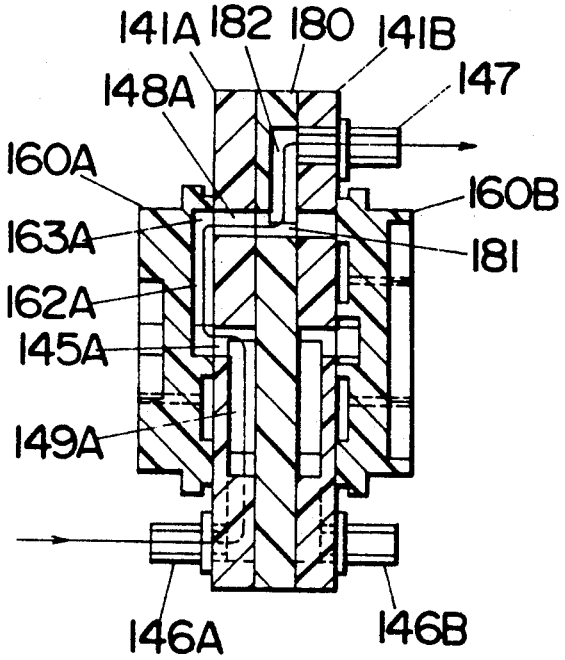
FIGS. 33 and 34 are sectional views of a portion of the distributor assembly for illustration of flow courses respectively for supplying and evacuating to and from the air bags, respectively.
Figure 34:
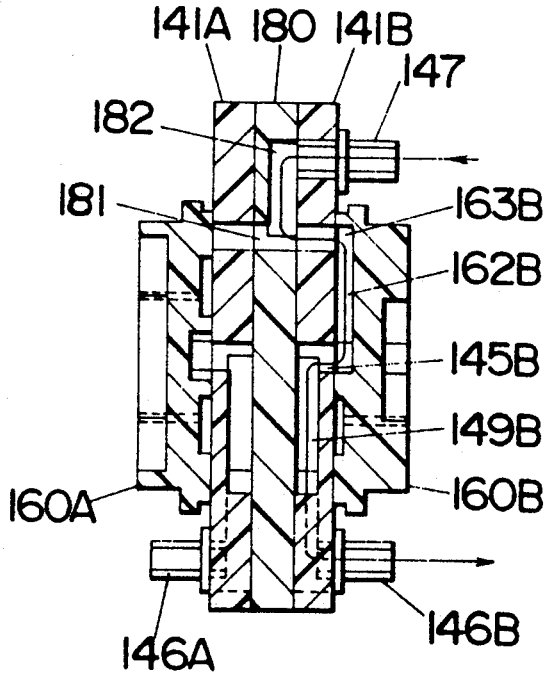
Figure 41:
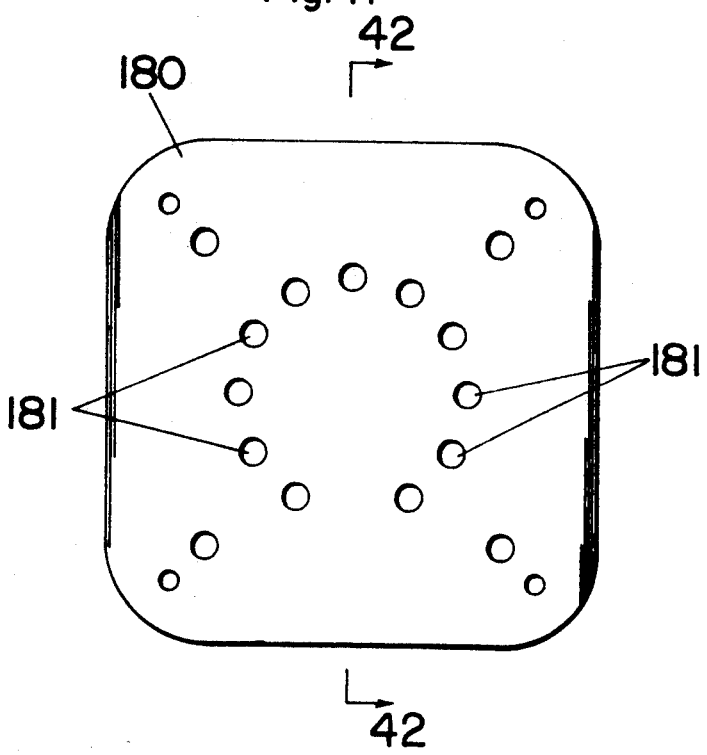
FIG. 41 is a front view of a channel plate utilized in combination with the intake valve plate.
Figure 42:
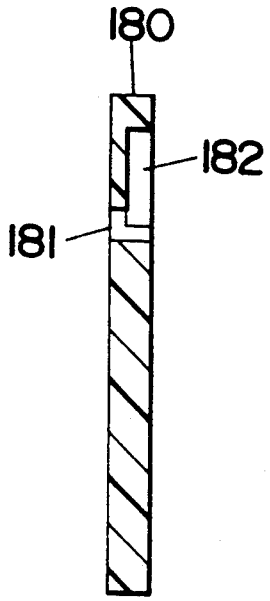
FIG. 42 is a cross section taken along line 42—42 of FIG. 41.
Figure 43:
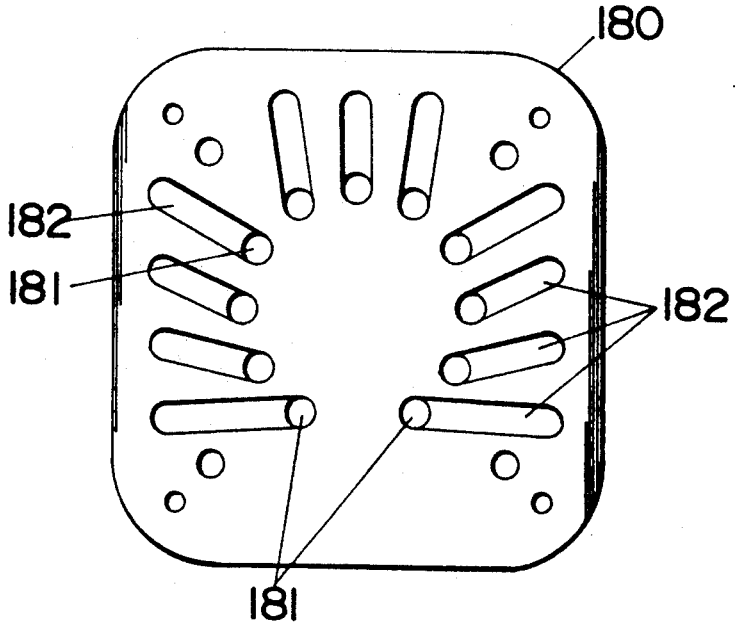
FIG. 43 is a rear view of the channel plate.

The channel plate 180 is formed with eleven ports 181 in registration with the peripheral through-holes 148A and 148B of the intake and exhaust valve plates 141A and 141B, as shown in FIGS. 41 to 43. Each of the ports 181 is connected at its one end with each one of elongated slots 182 formed in the surface of the channel plate 180 opposing the exhaust valve plate 141B. The elongated slots 182 extends outwardly and terminate at positions for registration respectively with the air ports 147-0 to 147-10 to establish the individual flow paths between the ports 181 and the air ports 147-0 to 147-10, as best shown in FIGS. 33 and 34.

The valve disks 160A and 160B are controlled individually by the stepper motors 150A and 150B in such a manner as to selectively inflate the base mat 100 and the air bags 101 to 110 while allowing to collapse the same. When feeding the compressed air from the pump 130, the valve disk 160A is rotated stepwise to a position of communicating the passage 163A of the radial channel 162A with desired one of the peripheral through-holes 148A of the intake valve plate 141A, as shown in FIG. 33, thus permitting the compressed air from the pump 130 to pass through a route of intake ports 146A, Y-shaped groove 149A, center through-hole 145A of the intake valve plate 141A, radial channel 162A, passage 163A of the vale disk 160A, peripheral through hole 148A of the valve plate 141A again, port 181, slot 182 of the channel plate 180, and air port 147 of the exhaust valve plate 141B to the associated one or ones of the base mat 100 and the air bags 101 to 110. Thus, by controlling the angular disposition of the valve disk 160A, the compressed air is fed selectively to the base mat 100 and the air bags 101 to 110 for selective inflation thereof. On the other hand, when collapsing the base mat 100 and the air bags 101 to 110, the valve disk 160B is controlled to rotate stepwise to a position of FIG. 34, in which the radial channel 162B is in communication at its passage 163B with a desired one of the peripheral through holes 148B of the exhaust valve plate 141B, as shown in FIG. 34, thereby permitting the internal air from the associated one or ones of the base mat 100 and the air bags 101 to 110 to flow back through a route of the air port 147, slot 182, port 181, peripheral through-hole 148B, passage 163B, radial channel 162B, center through-hole 145B, Y-shaped groove 149B, and exhaust ports 146B to the exhaust line 190. In this manner, the base mat 100 and the air bags 101 to 110 are selectively collapsed by controlling the stepwise angular displacement of the valve disk 160B. Consequently, by suitable controlling the valve disks 160A and 160B independently, it is possible to achieve the like rest mode application and various massage modes application as effected in the first embodiment and even more sophisticated massage actions of inflating and collapsing any desired combination of the air bags 101 to 110 at a time.

What is claimed is:

1. An air massaging apparatus comprising:

a plurality of generally elongated, inflatable air bags arranged in side-by-side relation along a line of arrangement;

a pump supplying compressed air to inflate said air bags;

distributing means for channeling said compressed air from said pump selectively to said air bags and for inflating said air bags one after another sequentially in a predetermined direction along said line of arrangement in such a manner as to inflate at least one air bag at a time while evacuating the compressed air from the remaining air bags;

said distributing means comprising:

a stepper motor capable of rotating in a stepping motion in either forward or reverse directions;

a valve casing having an inlet port which receives said compressed air from said pump and a plurality of air ports respectively connected in communication with at least one of said air bags for channeling said compressed air to selectively inflate at least one of said air bags, said inlet port disposed at a center of said valve casing, and said air ports arranged radially about said inlet port at substantially equal angular distances;

a valve disk driven by said stepper motor to rotate about a rotation axis relative to said valve casing;

said valve disk formed with a radial channel having an inner and an outer end, said inner end being in constant communication with said inlet port and said outer end being in selective communication with said air ports, said valve disk rotating stepwise either in a forward or reverse direction, whereby one stepwise rotation of said valve disk causes said outer end of said radial channel to move from one of said air ports by one step to an adjacent one of said air ports; and control means for rotating said valve disk in a local sequence in which firstly the valve disk is rotated in the forward direction so as to move said outer end of said radial channel from first an original one of said air ports by at least one step to a second one of said air ports and secondly, said valve disk is rotated in the reverse direction so as to move said outer end of said radial channel from said second air port back by at least one step toward said original first air port;

said local sequence being repeated with a different air port, from said original first air port, being defined as a new first air port, said different airport located in the forward direction by at least one step from the original first air port, thereby temporarily inflating said air bags in a reverse order, over a limited number of said air bags, during an overall operation of sequentially inflating said air bags in the forward direction.

2. An air massaging apparatus as set forth in claim 1, further including:

pressure controlling means for adjusting the pressure of the compressed air filled in the individual air bags; and speed controlling means for adjusting a cycle of sequentially inflating said air bags independently of the operation of said pressure controlling means.

3. An air massaging apparatus as set forth in claim 1, further including:

an inflatable base mat on which said air bags are disposed, said base mat dimensioned for use as a bed upon which the user may lie down;

means capable of selectively providing a massaging mode of sequentially inflating said air bags to apply a massaging action to a user's body, portion by portion, and a rest mode for keeping said base mat inflated by said compressed air from said pump so as to support the user's body thereon.

4. An air massaging apparatus as set forth in claim 3, wherein said base mat is collapsed into a flattened shape by evacuation of said compressed air therefrom when said massaging mode is selected and said air bags are collapsed into a flattened shape by evacuation of said compressed air therefrom when said rest mode is selected.

5. An air massaging apparatus as set forth in claim 3, further comprising means for effecting repeat raising and lowering of air pressure within said base mat at a predetermined cycle when said rest mode is selected.

6. An air massaging apparatus as set forth in claim 3, wherein said base mat comprises an inflatable balloon surround by a covering, said balloon being made of a stretchable material elastically deformable into a generally rectangular planar configuration having top and bottom sheets, said balloon formed internally with a plurality of suspension ribs connecting said top and bottom sheets at portions spaced along at least one dimension of said balloon in order to restrict undue swelling of said balloon, said covering and suspension ribs being both made of a non-stretchable material having no substantial elastic deformability.

7. An air massaging apparatus as set forth in claim 3, wherein said base mat has a number of minute perforations through which air inside is allowed to flow outwardly, said base mat being controlled to be supplied with the compressed air through said distributing means each time at least one of said air bags is evacuated such that the compressed air supplied to said base mat is allowed to flow outwardly through said minute perforations to provide an air stream toward the user's body lying on said air bags.

8. An air massaging apparatus as set forth in claim 1, wherein at least one additional air bag is superimposed on one of said air bags and cooperates therewith to define a waist massaging section, said superimposed air bags and said one of said air bags being controlled to inflate simultaneously by said compressed air.

9. An air massaging apparatus as set forth in claim 1, wherein said local sequence is defined to move said outer end of said radial channel back and forth between said first one of said air ports and an immediately adjacent one of said air ports by one said step, and said local sequence is repeated with said first air port being advance by one said step to the forwardly adjacent one of said air ports.

10. An air massaging apparatus as set forth in claim 9, wherein said outer end of said radial channel is circumferentially elongated about said rotation axis so as to define an extended passage; wherein, depending upon angular position of said valve disk about said rotation axis, said extended passage is in communication with at least one of a plurality of adjacent air ports.

11. An air massaging apparatus as set forth in claim 10, wherein said valve disk is formed with a chamber extending about said rotation axis and configured so as to be brought into communication with all of said air ports except for said air port or ports which are currently in communication with the extended passage of said radial channel, said chamber also formed with an exhaust port for allowing the escape of compressed air from the air bags which are not currently supplied with the compressed air from said pump.

12. An air massaging apparatus as set forth in claim 1, wherein said distributing means comprises a first distributor for channeling said compressed air to said air bags for selective inflation thereof and a second distributor for channeling said compressed air selectively from said bags to the outside for selective evacuation thereof.

* * * * *